US011703271B2

(12) United States Patent
Lee et al.

(10) Patent No.: US 11,703,271 B2
(45) Date of Patent: Jul. 18, 2023

(54) REFRIGERATOR

(71) Applicant: LG Electronics Inc., Seoul (KR)

(72) Inventors: Jonghyun Lee, Seoul (KR); Wonchan Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/475,666

(22) Filed: Sep. 15, 2021

(65) Prior Publication Data

US 2022/0107129 A1 Apr. 7, 2022

(30) Foreign Application Priority Data

Oct. 6, 2020 (KR) ..... 10-2020-0128947

(51) Int. Cl.
*F25D 23/02* (2006.01)
*E05F 5/06* (2006.01)

(52) U.S. Cl.
CPC ..... *F25D 23/028* (2013.01); *E05F 5/06* (2013.01); *E05Y 2900/31* (2013.01)

(58) Field of Classification Search
CPC ..... F25D 23/028; F25D 2323/0011; F25D 23/087; F25D 2323/021; F25D 2400/18; E05F 5/06; E05Y 2900/31
See application file for complete search history.

(56) References Cited

U.S. PATENT DOCUMENTS 8,894,168 B2 * 11/2014 Lee ..... E05F 5/06 16/86 A
10,544,983 B2 * 1/2020 Lee ..... F25D 29/005
2008/0265729 A1 * 10/2008 Netzer ..... A47B 88/40 312/330.1
2012/0093094 A1 4/2012 Zhang et al.
2021/0396448 A1 * 12/2021 Bae ..... F25D 11/02

FOREIGN PATENT DOCUMENTS

CN 201731718 U * 2/2011
CN 201892370 U * 7/2011
CN 203036954 U * 7/2013
CN 105371571 A * 3/2016
CN 205192036 U * 4/2016
CN 105157330 7/2017
(Continued)

OTHER PUBLICATIONS

Extended European Search Report in European Appln. No. 21193301.5 dated Feb. 9, 2022, 9 pages.

*Primary Examiner* — Hanh V Tran
(74) *Attorney, Agent, or Firm* — Fish & Richardson P.C.

(57) ABSTRACT

A refrigerator includes a cabinet having a storage space, a door configured to open and close the storage space, and a gap adjusting device configured to be provided between the cabinet and the door and to adjust a gap between the cabinet and the door, in which the gap adjusting device includes a seating part formed on the door, and an adjusting member which is detachably mounted on the seating part and is in contact with the cabinet in a state where the door is closed, a plurality of adjusting parts having different heights are formed on the adjusting member, and a gap between the cabinet and the door is adjusted according to a combination of a contact surface between the seating part and the adjusting part selected when the adjusting member is mounted.

20 Claims, 28 Drawing Sheets

(56) References Cited

FOREIGN PATENT DOCUMENTS

| | | | | | |
|---|---|---|---|---|---|
| CN | 105157330 | B | * | 7/2017 | |
| CN | 107328160 | A | * | 11/2017 | |
| CN | 207455986 | U | * | 6/2018 | |
| CN | 110986459 | B | * | 3/2021 | ..... F25D 11/02 |
| CN | 213396084 | U | * | 6/2021 | |
| EP | 3926270 | | | 12/2021 | |
| KR | 1020120137501 | | | 12/2012 | |
| KR | 20140102081 | | | 8/2014 | |
| KR | 20140102081 | A | * | 8/2014 | |
| KR | 101651139 | | | 8/2016 | |
| KR | 20190066721 | | | 6/2019 | |

* cited by examiner

REFRIGERATOR

CROSS-REFERENCE TO RELATED APPLICATION(S)

This application claims priority to Korean Patent Application No. 10-2020-0128947, filed in Korea on Oct. 6, 2020, the entire contents of which is hereby incorporated by reference in their entirety.

BACKGROUND

The present disclosure relates to a refrigerator.

In general, refrigerators are home appliances that allow low-temperature storage of food in an internal storage space that is shielded by a refrigerator door and are configured to store stored foods in an optimal condition by using cold air generated through heat exchange with a refrigerant circulating in a refrigeration cycle to cool the interior of the storage space.

As such, refrigerators are gradually becoming larger and multifunctional in accordance with changes in dietary life and high-end products, and refrigerators having various structures and convenience devices in consideration of user convenience are being released.

In addition, in a case where a plurality of doors are disposed side by side in one refrigerator, or in a case where a plurality of refrigerators are disposed in a row when the heights in the front and rear directions between the doors do not match, the outer appearance thereof is not good and there is a problem that may cause user complaints.

In order to prevent this problem, a refrigerator is known, which includes a gap adjusting device which is fixed to a door, wherein the door is in contact with the main body when the door is closed to be capable of adjusting the step of the door is disclosed in Korean Patent Laid-Open Publication No. 10-2012-00137501.

However, in such a conventional refrigerator, the structure of the gap adjusting device is complicated, and the coupling structure of the gap adjusting device mounted on the door to enable height adjustment is not concise, and thus productivity and assembly workability thereof are poor.

In addition, there are problems that it is difficult to check the adjusted height when the user adjusts the step by adjusting the gap adjusting device, and the user cannot easily adjust the door step since a structure is provided in which the step has to be adjusted while checking the degree of protrusion of the door from the surrounding components in a state when the door is closed.

In addition, in the prior art, there is a problem that since the gap adjusting device adjusts the protrusion height thereof by rotational manipulation and a separate constraint structure is not provided in the adjusted state, in the process of opening and closing the door, the adjustment state of the gap adjusting device is unintentionally changed due to friction or carelessness of the user.

SUMMARY

It is an object of the present disclosure to provide a refrigerator having a simple structure for adjusting a step of a refrigerator door.

It is further object of the present disclosure to provide a refrigerator having a structure in which an adjustment height can be intuitively identified when a step of a refrigerator door is adjusted.

It is further object of the present disclosure to provide a refrigerator capable of improving convenience in a step adjustment manipulation of a refrigerator door.

It is further object of the present disclosure to provide a refrigerator capable of continuously maintaining a step adjustment state of a refrigerator door.

The object is solved by the features of the independent claims. Preferred embodiments are given in the dependent claims.

A refrigerator according to an embodiment of the present disclosure includes a cabinet forming a storage space, a door for opening and closing the storage space, and a gap adjusting device between the cabinet and the door and configured to adjust a gap between the cabinet and the door. The gap adjusting device may include a seating part formed on the door, and an adjusting member which is detachably mounted on the seating part and is in contact with the cabinet when the door is closed.

The adjusting member may rotatably detachably mounted on the seating part.

A plurality of adjusting parts having different heights may be formed on the adjusting member.

A gap between the cabinet and the door may be adjusted according to a combination of a contact surface between the seating part and the adjusting part selected when the adjusting member is mounted.

The seating part protrudes from the rear surface of the door and may be inserted into the adjusting member.

The adjusting part may be formed inside the seating part.

The adjusting parts having different heights from each other may be arranged stepwise in a rotational direction with respect to the center of the adjusting member.

The adjusting parts having different heights from each other have adjacent ends connected to each other and may be sequentially formed to be stepped.

A gasket, which is in contact with the front surface of the cabinet to airtight between the door and the cabinet, The gasket may be provided on the rear circumference of the door.

The height of the gap adjusting device may be adjusted to correspond to the thickness of the gasket exposed in a state when the door is closed.

One or more support parts being in contact with the adjusting part and having different heights from each other may be formed on the seating part.

The adjusting member may be rotated with respect to the seating part to select a combination of a contact surface between the adjusting part and the support part.

The seating part may include a seating part body protruding from the rear surface of the door A seating part space may be formed in the seating body and is opened rearward to receive a part of the adjusting member.

The support part may include a plurality of main support parts formed on the seating part body, and a plurality of sub support parts formed in the seating part space.

The main support part may be formed in multiple stages along the circumference of the protruding end portion of the seating part body.

The sub support part may be formed in the space of the seating part space, and the plurality of sub support parts may protrude from a position facing each other to different heights.

The adjusting member may include a contact part which is in contact with the cabinet when the door is closed.

The adjusting member may include a circumferential part extending from the circumference of the contact part toward the rear surface of the door.

The adjusting member may include a protrusion part protruding from the inside of the adjusting member space formed by the circumference part toward the rear surface of the door The circumferential part may be in contact with an outer surface of the seating part body and the protrusion part may be inserted into the seating part space.

The cross-section of the protrusion part and the seating part space may be formed in a polygonal shape corresponding to each other.

The adjusting part may include one or more main adjusting parts formed inside the adjusting member space and protruding at different heights along a part between the circumferential part and the protrusion part.

One or more sub adjusting parts may be formed at different heights along the circumference of the extended end portion of the protrusion part.

When the adjusting member is mounted, the main adjusting part may be in contact with the main support part, and the sub adjusting part may be in contact with the sub support part.

At least two of the plurality of main adjusting parts and the main support part and a plurality of sub adjusting parts and the sub support parts may be in contact with each other and may be disposed at positions facing each other.

One or more fixing protrusions protruding outward may be formed on the circumferential surface of the seating part.

One or more fixing grooves into which the fixing protrusion is inserted and which constrains the adjustment member may be formed on inner surface of the adjustment member.

When the fixing protrusion is inserted into the fixing groove, the seating part may be in contact with the adjusting part.

An indicating part which indicates the height of the adjusting part may be formed on the rear surface of the adjusting member which is in contact with the cabinet.

The indicating part may be formed at a position corresponding to each of the adjusting parts.

A guide part which protrudes outwardly from a position corresponding to each of the adjusting parts to visualize the correct mounting direction of the adjusting member may be formed on the circumferential surface of the adjusting member.

An upper cap deco forming an upper surface of the door may be provided at the upper end of the door.

The seating part may be formed integrally with the upper cap deco on a rear surface of the upper cap deco.

The cabinet may include a top cover protruding upward from an upper surface of the cabinet and receives a hinge to which the door is rotatably coupled.

When the door is closed, the adjusting member may be in contact with a front surface of the top cover.

At least a portion of the adjusting member may be formed of an elastic material.

DETAILED DESCRIPTION OF THE EMBODIMENTS

Hereinafter, specific embodiments of the present disclosure will be described in detail together with the drawings. However, the present disclosure cannot be said to be limited to the embodiments in which the spirit of the present disclosure is presented, and other disclosures that are regressive by addition, change, deletion, or the like of other components, or other embodiments included within the spirit scope of the present disclosure can be easily suggested.

Define the direction prior to the explanation thereof. According to an embodiment of the present disclosure, the direction toward the front surface of the door as illustrated in FIG. 1 can be defined as front, the direction toward the cabinet with respect to the front surface of the door can be defined as rear, and the direction toward the floor where the refrigerator is installed can be defined as downward, and the direction away from the floor can be defined as upward.

Figure 1:
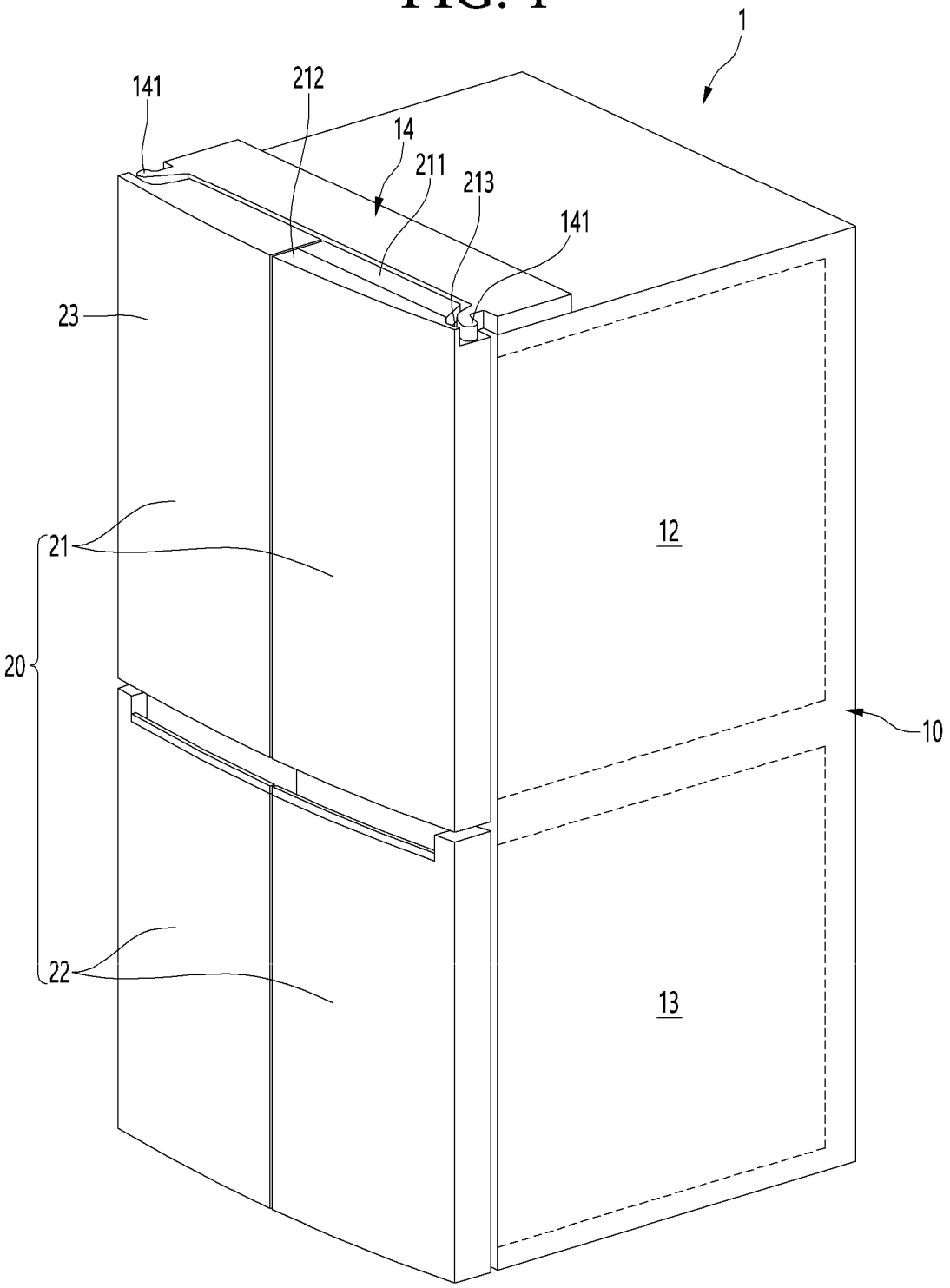
FIG. 1 is a perspective view illustrating a refrigerator of an embodiment of the present disclosure.
Figure 2:
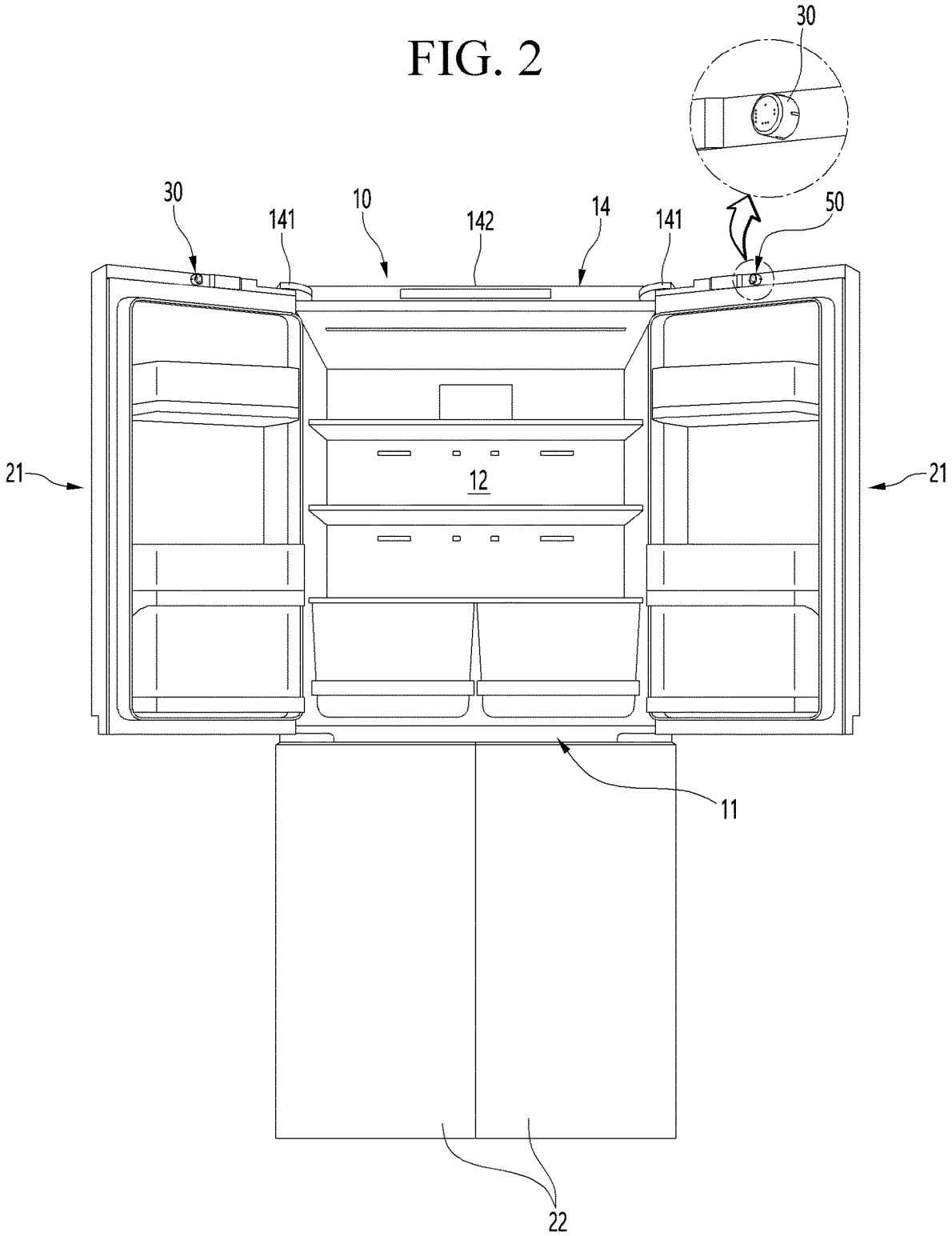
FIG. 2 is a perspective view illustrating a state when the door of the refrigerator is opened.

FIG. 1 is a perspective view illustrating a refrigerator according to an embodiment of the present disclosure, and FIG. 2 is a perspective view illustrating a state where the door of the refrigerator is opened.

As illustrated in the drawings, a refrigerator 1 according to an embodiment of the present disclosure may include a cabinet 10 forming a storage space, and a door 20 mounted on the opened front surface of the cabinet 10 for opening and closing the storage space.

The cabinet 10 may include a barrier 11. Accordingly, the storage space may be divided by the barrier 11 into an upper storage space 12 and a lower storage space 13. The upper storage space 12 can be used as a refrigerating compartment with high frequency of use because the upper storage space 12 is easy for a user to access, and the lower storage space 13 can be used as a freezing compartment.

A top cover 14 may be provided at the front end of the upper surface of the cabinet 10. A hinge connecting an upper surface of the cabinet 10 and an upper end of the upper door 21 may be received in the top cover 14 or in an upper portion of the cabinet.

The top cover 14 may be provided at the front end of the upper surface of the cabinet 10, and hinge parts 141 protruding toward the upper end of the upper door 21 can protrude from both side ends of the top cover 14. In addition, the front surface of the top cover 14 may be located on the same plane as the front surface of the cabinet 10, and a display 142 may be provided to display the operating state of the refrigerator 1. In addition, the display 142 may further include a manipulation part for setting or manipulating the operation of the refrigerator 1.

The front surface of the top cover 14 may be in contact with a gap adjusting device 50 that maintains a gap between the upper door 21 and the front surface of the cabinet 10 when the upper door 21 is closed.

Meanwhile, the top cover 14 may be provided as a single or one part configuration, but may be provided also provided as multiple part on the left and right sides of the upper surface of the cabinet 10, respectively, and may have various disposition structures capable of receiving the hinge and being simultaneously in contact with the gap adjusting device 50. In addition, since the top cover 14 is integrally coupled to the upper surface of the cabinet 10, the top cover 14 may be regarded as a part of the cabinet 10 or as a component of the cabinet 10. So, the front surface of the cabinet may face the inner or rear surface of the door having the gap adjusting device 50 therebetween.

The door 20 may include an upper door 21 for closing or shielding the upper storage space 12 and a lower door 22 for closing or shielding the lower storage space 13. The upper door 21 may be referred to as a refrigerating compartment door, and the lower door 22 may be referred to as a freezing compartment door.

The upper door 21 is configured as a pair of doors and can be opened and closed by rotating to open or close the one or more upper storage spaces 12, respectively. The upper door 21 may be referred to as a French type door or may be referred to as a refrigerating compartment door.

The gap adjusting device 50 may be provided at the upper end of the rear surface of each of the one or more upper doors 21. The gap adjusting device 50 may be in contact with the front surface of the cabinet 10 or the front surface of the top cover 14 in a state when the upper door 21 is closed. The gap adjusting device 50 may be configured to enable adjustment of a height protruding from the rear surface of the upper door 21. Accordingly, the protrusion height of the front surface of the upper door 21 may be adjusted by the adjustment of the gap adjusting device 50. The pair of upper doors 21 may be adjusted by the gap adjusting device 50 such that the heights of the front surfaces thereof are the same.

The term "height" is used within this description to represent a "distance", which extends substantially in a horizontal direction. So, the heights of the doors is adjusted by the gap adjusting device 50, so that the planes or front surfaces are flushing to each other or from one single plane without any step there between. At least one of the pair of upper doors 21 may be include a main door 20 and a sub door 20. The main door 20 is configured to open and close the upper storage space 12, and a sub door 20 for opening and closing an opening formed in the main door 20 may be connected to the main door 20 by a sub hinge 213. The gap adjusting device 50 may be formed on the rear surface of the main door 20.

Like the upper door 21, the lower door 22 may include a pair of doors on both left and right sides, and the lower storage space 13 may be opened and closed. Further, although not illustrated in detail, the gap adjusting device 50 is also provided in the lower door 22 so that the protrusion height of the front surface of the lower door 22 may be adjusted.

Meanwhile, the gap adjusting device 50 may be mounted regardless of the type and disposition of the door 20. Therefore, hereinafter, for convenience of explanation and understanding, the upper door 21 will be referred to as the door 20.

Figure 3:
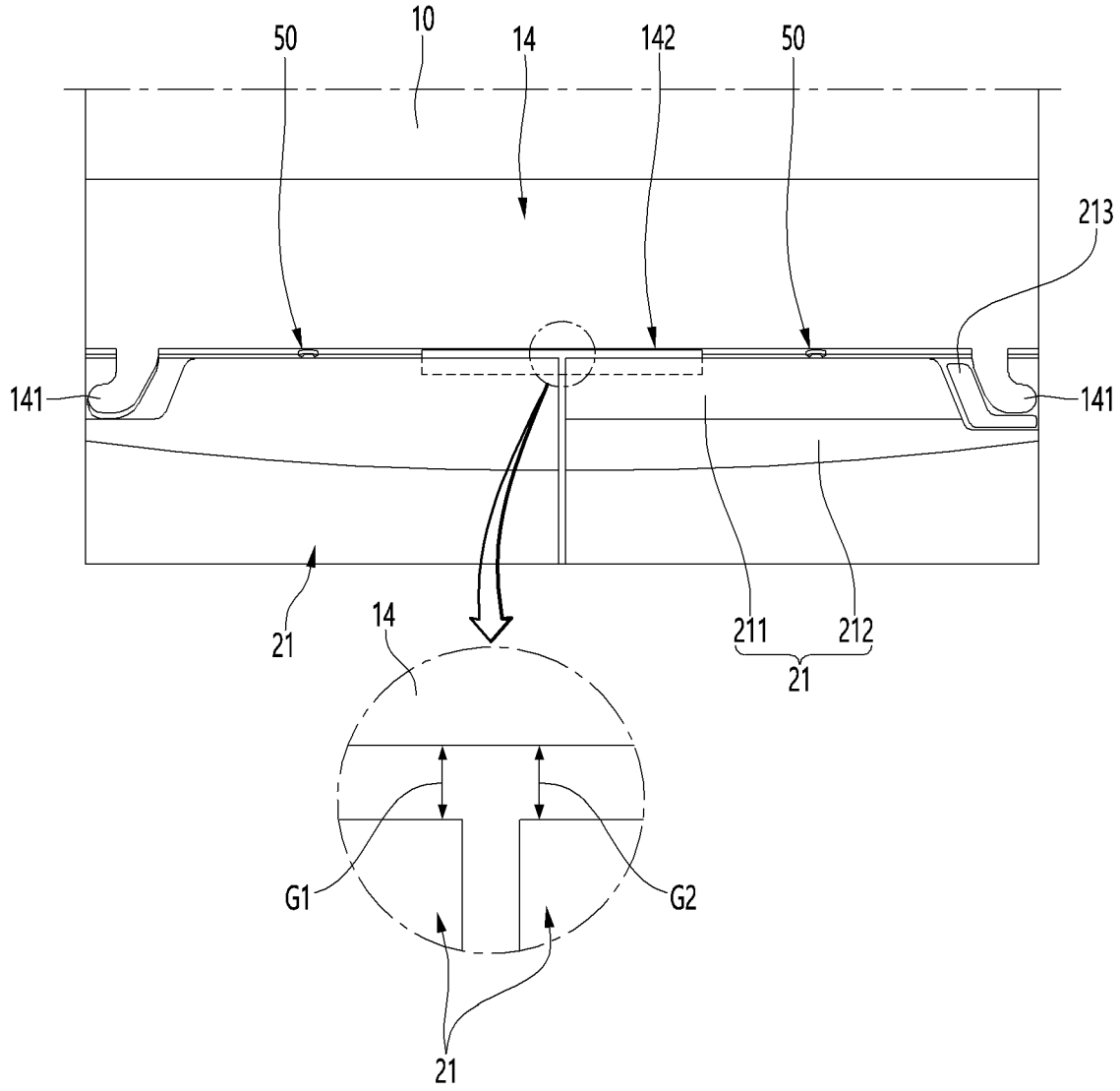
FIG. 3 is a partial perspective view illustrating a state of the upper end of the door and the cabinet in a state when the door is closed.
Figure 4:
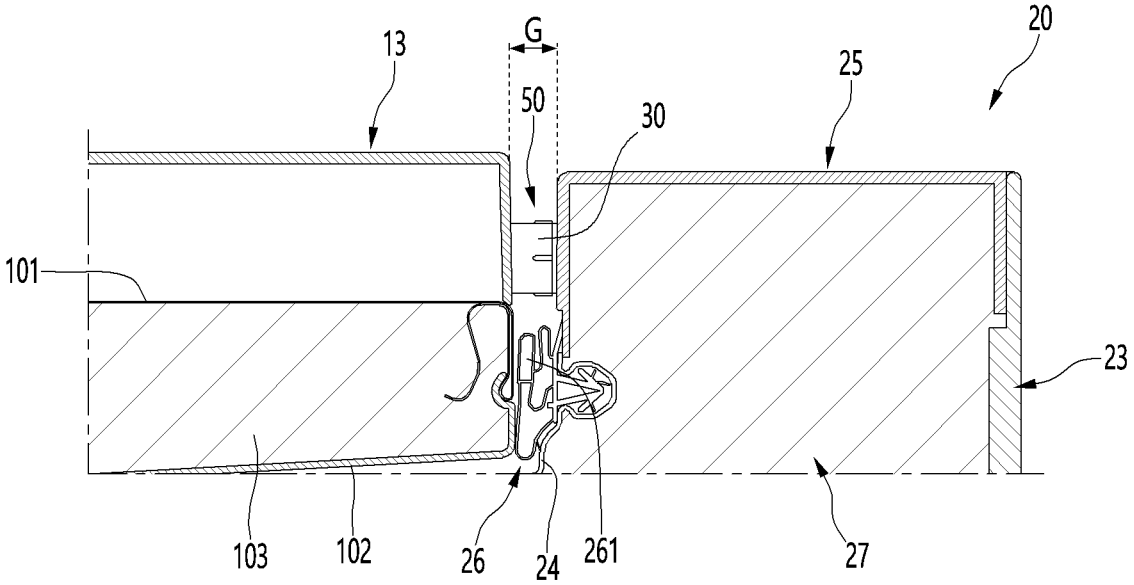
FIG. 4 is a cross-sectional view taken along line IV-IV' of FIG. 1.

FIG. 3 is a partial perspective view illustrating a state of the upper end of the door and the cabinet in a state when the door is closed, and FIG. 4 is a cross-sectional view taken along line IV-IV' of FIG. 1.

As illustrated in the drawings, the cabinet 10 may include an outer case 101 made of a steel material forming an outer appearance thereof and an inner case 102 forming the interior of the storage space 12, and an insulating material 103 may be filled between the outer case 101 and the inner case 102.

The front end of the outer case 101 may be bent to be coupled with the outer case 101, and thus at least a part of the front surface of the cabinet 10 may be formed by the outer case 101. When the door 20 is closed, the gasket 26 formed along the circumference of the door 20 is in contact with the front surface of the cabinet 10 to prevent leakage of cold air inside the storage space.

In particular, a magnet 261 may be provided inside the gasket 26, and when the door 20 is closed, the gasket 26 can be maintained in a state of being attached to the front surface of the cabinet, that is, the bent front surface of the outer case 101 by the magnetic force of the magnet 261.

The top cover 14 may be mounted on the upper surface of the cabinet 10. The top cover 14 has an opened bottom surface, and the opened bottom surface may be shielded by being mounted on the cabinet 10. In a state when the top cover 14 is mounted on the upper surface of the cabinet 10, the front surface of the top cover 14 may form the same plane as the front surface of the cabinet 10. The front surface of the top cover 14 may be in contact with the rear surface of the gap adjusting device 50 in a state when the door 20 is closed.

In detail, the gap adjusting device 50 protrudes from the rear surface of the door 20 to the rear. It may be located further outside the gasket 26. Therefore, when the door 20 is closed, the gasket 26 is in close contact with the front surface of the cabinet 10 by magnetic force, and the gap adjusting device 50 is in contact with the front surface of the top cover 14. The gap adjusting device 50 may be mounted on the rear surface of the cab deco 25 to be described below.

The gap G between the door 20 and the cabinet 10 may be adjusted by the gap adjusting device 50. In other words, when the user manipulates the gap adjusting device 50, the protrusion height of the gap adjusting device 50 may be adjusted, and as a result, the gap G between the door 20 and the cabinet 10 can be adjusted. Accordingly, it may be said that the protrusion height of the gap adjusting device 50 corresponds to the thickness of the gasket 26 exposed in a state when the door 20 is closed.

The gap adjusting device 50 may be provided on all of the pair of doors 20. Accordingly, the gaps G1 and G2 of the pair of doors 20 may be adjusted by the manipulation of the gap adjusting device 50, respectively. In other words, when the protrusion heights of the front surface are different from each other in a case when the left and right doors 20 are closed, the protrusion height of the doors 20 may be made the same through the manipulation of the gap adjusting device 50 provided in each of the doors 20.

There might be a display 142 in/on the front surface of the upper portion of the cabinet or at the top cover 14 to provide operation information of the refrigerator to the user.

In this case, the gap adjusting device 50 may be in contact with the front surface of the top cover 14 and may be located in an area between the hinge part 141 and the display 142. Accordingly, it is possible to prevent the display 142 from being in contact with the gap adjusting device 50 while the door 20 is opened or closed.

Hereinafter, the structure of the door 20 and the disposition of the gap adjusting device 50 will be described in more detail with reference to the drawings.

Figure 5:
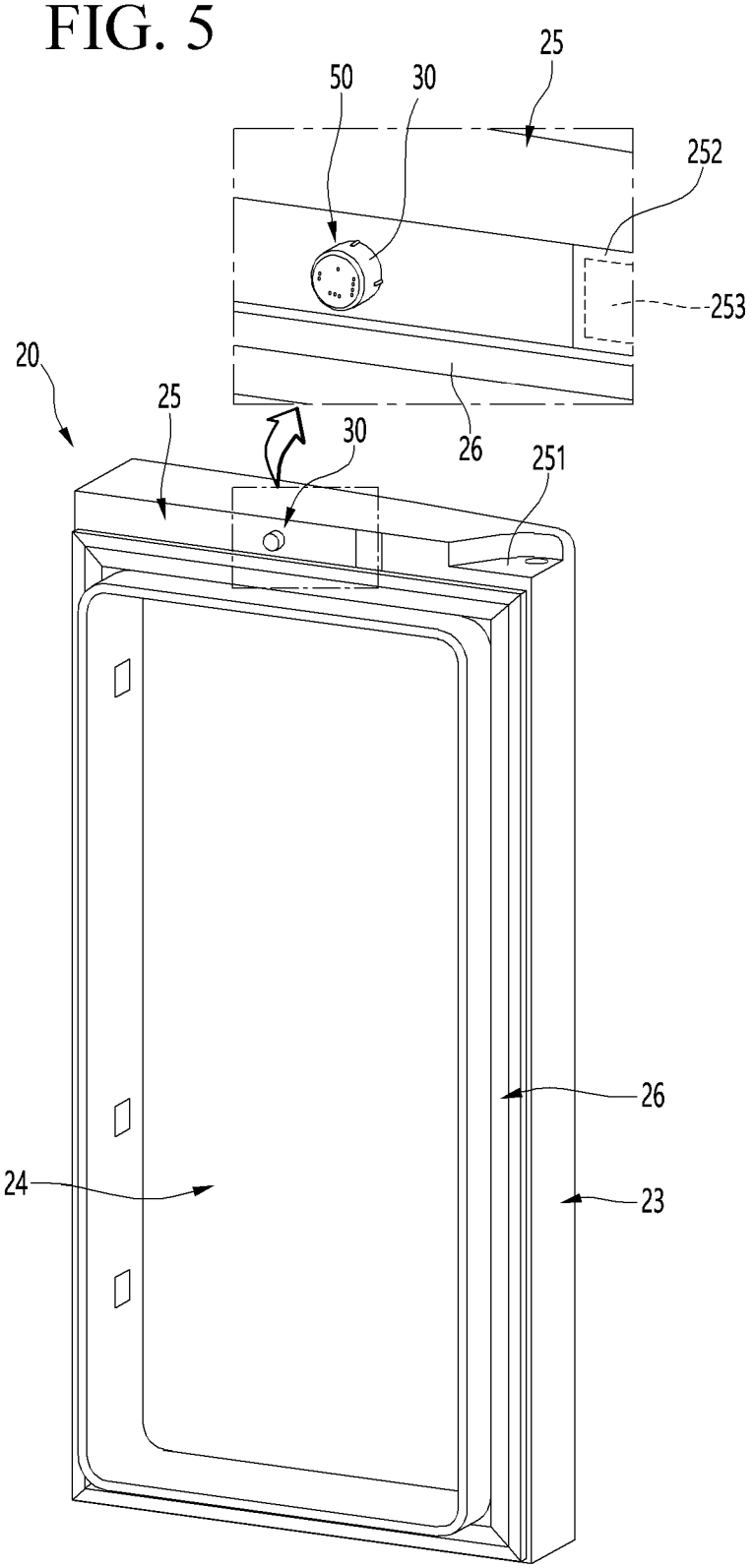
FIG. 5 is a perspective view illustrating the door viewed from the rear.
Figure 6:
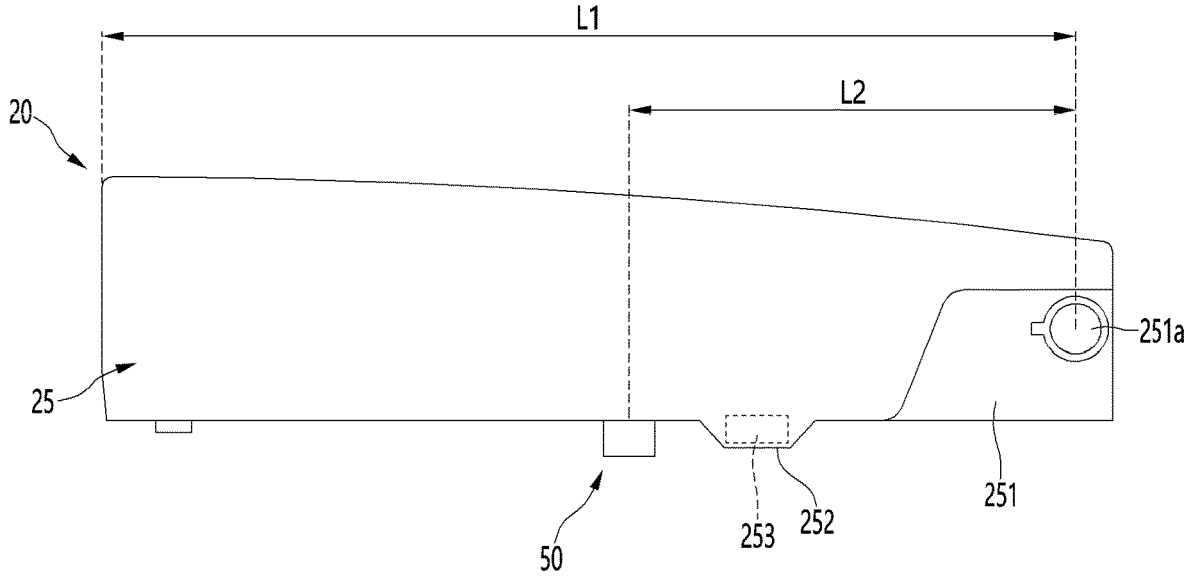
FIG. 6 is a plan view illustrating the upper surface of the door.
Figure 7:
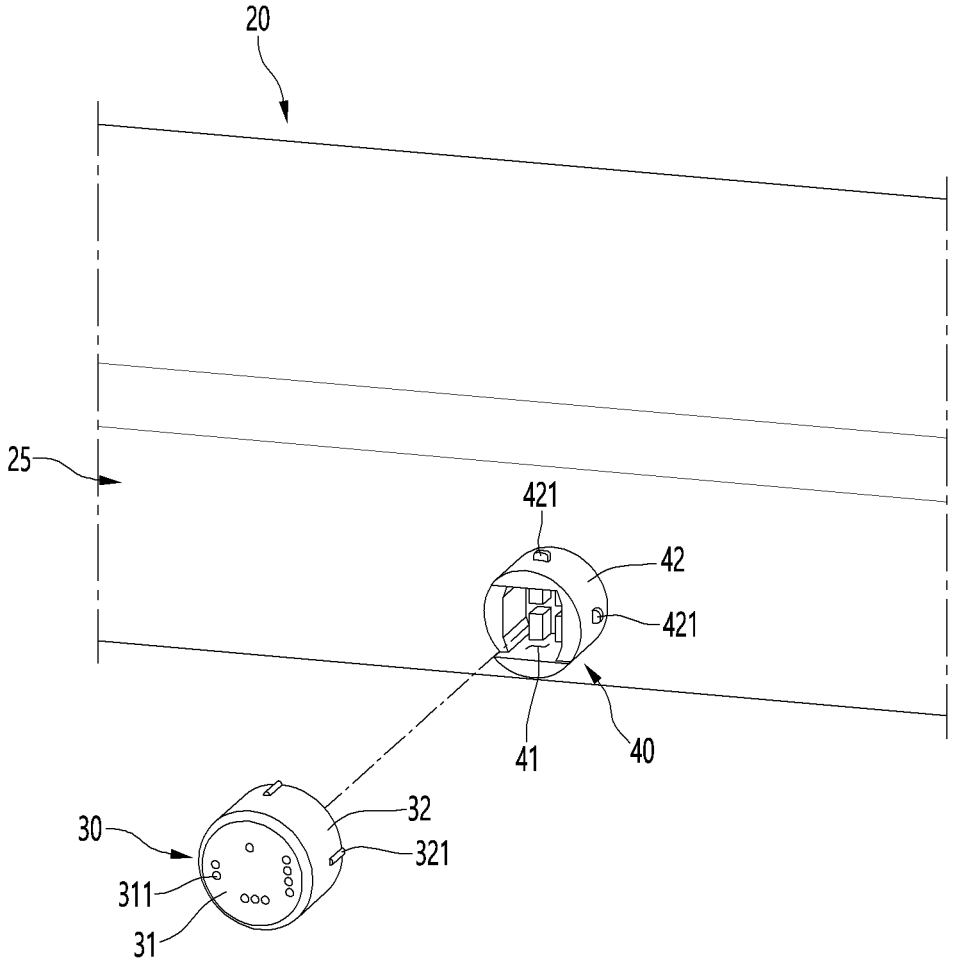
FIG. 7 is an exploded perspective view illustrating a coupling structure of a gap adjusting device according to an embodiment of the present disclosure.

FIG. 5 is a perspective view illustrating the door viewed from the rear, FIG. 6 is a plan view illustrating the upper surface of the door, and FIG. 7 is an exploded perspective view illustrating a coupling structure of a gap adjusting device according to an embodiment of the present disclosure.

As illustrated in the drawing, the door 20 may be formed by a front plate 23 forming a front surface, a door liner 24 forming a rear surface, and cap decos 25 forming an upper surface and a lower surface of the door. The cap deco is a cap for providing a stylish decoration to cover the contacting location of the front plate and the liner and to form the upper and lower limitation of the door. An insulating material 27 may be filled in the inner space of the door 20 formed by the coupling of the front plate 23, the door liner 24, and the cap decos 25.

In detail, the front plate 23 may be formed of a tempered glass or a metal material to form the front outer appearance of the door 20. The front plate 23 may be coupled to the door liner 24 and may further form a side outer appearance of the door 20.

The door liner 24 may be formed in a plate shape to form the outer appearance of the rear surface of the door 20 and may provide a structure in which a pocket or basket for storage is mounted. In addition, a gasket 26 may be mounted around the door liner 24. When the door 20 is closed, the gasket 26 may be in close contact with the front surface of the cabinet 10 to seal the storage space.

The gasket 26 may have a magnet 261 embedded therein so as to be in close contact with the front surface of the cabinet made of a steel material. In addition, the gasket 26 may be formed of an elastically deformable material and may have a structure capable of being extended when the door 20 is opened or closed.

The cap deco 25 may be formed of a plastic material, and a pair of top and bottom cap decos may be provided to be coupled to the upper and lower ends of the front plate 23 and the door liner 24, respectively. Meanwhile, the cap deco 25 forming the upper portion of the door 20 may include the upper surface of the door 20 and form the outer appearance of the rear surface.

The rear surface of the cap deco 25 may be formed in a flat shape and may form a surface facing the top cover 14 provided on the upper surface of the cabinet 10 and/or the upper end of the cabinet 10. A hinge mounting part 251 recessed to mount the hinge may be formed at one end of the cap deco 25.

A switch recognition part 252 in which a magnet 253 is embedded may be formed on one side of the rear surface of the cap deco 25 away or spaced apart from the hinge mounting part 251. The switch recognition part 252 is formed at a position corresponding to a door detection device (not illustrated) provided inside the top cover 14. In a state when the door 20 is closed, the switch recognition part 252 may recognize a closing state of the door 20 since the door is then in proximity to the door detection device. In this case, the door detection device may be configured to detect the magnet 253 provided inside the switch recognition part 252.

Meanwhile, the gap adjusting device 50 may be provided on the rear surface of the cap deco 25. The gap adjusting device 50 protrudes from the rear surface of the upper cap deco 25 and may contact the front surface of the cabinet 10 or the front surface of the top cover 14.

The gap adjusting device 50 is located further outside the gasket 26 and/or may be located in the center portion of the door 20. In detail, the gap adjusting device 50 may be located at a position separated by a set distance L2 from the hinge hole 251*a* into which the rotation shaft of the hinge is inserted. In this case, the set distance L2 may be formed to be approximately 45% to 50% of the length when compared to the total transverse length L1 of the door 20.

Accordingly, when the height of the gap adjusting device 50 is adjusted, the protrusion height from the end portion of the door 20 can be adjusted by approximately twice. For example, when the height of the gap adjusting device 50 is adjusted by 0.25 mm, the protrusion height of the end portion of the door 20 may be adjusted by 0.5 mm.

Meanwhile, the position of the gap adjusting device 50 may be disposed at a position that does not interfere with the switch recognition part 252. In other words, the gap adjusting device 50 may be located in an area between the switch recognition part 252 and the end portion of the door 20 and may be disposed in the middle portion of the total length of the door 20 in the transverse direction.

The gap adjusting device 50 may protrude more than the switch recognition part 252 even at the lowest protrusion height and may be configured to maintain contact with the gasket 26 even at the maximum protrusion height. In other words, the gap control device 50 may be adjusted to a height such that the gasket 26 is not separated from the cabinet 10 at a height where the switch recognition part 252 does not interfere with the cabinet 10.

The gap adjusting device 50 is disposed at a position facing the front surface of the top cover 14 so that the gap adjusting device 50 may be in contact with the top cover 14 when the door 20 is closed. In addition, the front surface of the top cover 14 has the same plane as the front surface of the cabinet 10, and thus, the gap G between the door 20 and the cabinet 10 can be adjusted by the gap adjusting device 50. In addition, the top cover 14 is a component of the cabinet 10, and therefore, the gap adjusting device 50 may be in contact with the front surface of the cabinet 10. The gap adjusting device 50 may be configured to be in contact with the top cover 14, and the top cover 14 may be omitted depending on the height of the cabinet 10.

The gap adjusting device 50 may be supported by the cabinet 10 when the door 20 is closed and may serve as a stopper.

Meanwhile, the gap adjusting device 50 can adjust the degree of protrusion from the rear surface of the door 20, and the gap G between the rear surface of the door 20 and the front surface of the cabinet 10 can be adjusted by the manipulation of the gap adjusting device 50. Through the gap adjusting device 50, the degree of protrusion in the front of the door 20 may be adjusted, and the entire front surface of the other door 20 disposed adjacent to each other may be adjusted to be flat.

In other words, in a state when the door 20 is closed, in a case when a step is generated due to a height difference in the front and rear direction from the other door 20 disposed adjacently, the gap adjusting device 50 may be manipulated to adjust the protrusion height of the one or more doors 20, and thus it is possible to be positioned on the same plane without being stepped from the neighboring door 20.

The gap adjusting device 50 may include an adjusting member 30 which is in contact with the cabinet 10 or the top cover 14 and protrudes from the rear surface of the cap deco 25, and a seating part 40 on which the adjusting member 30 is mounted.

The adjusting member 30 may be formed of an elastic material such as rubber, urethane, or silicone, and when the door 20 is closed, the adjusting member 30 is in contact with the front surface of the cabinet 10 or the top cover 14 to be capable of mitigating the impact.

The adjusting member 30 may be formed in a cylindrical shape. The adjusting member 30 may include a contact part 31 formed in a circular shape and a circumferential part 32 extending along the circumference of the contact part 31. However also other outer shapes of the adjusting member 30 and of the seating parts 40 are possible as long as the adjusting member 30 can be rotated around the seating part 40.

The height of the adjusting member 30 can be adjusted when the adjusting member 30 is mounted on the seating part 40, and when the adjusting member 30 is mounted on the seating part 40 while being rotated by a set angle, the adjusting member 30 can protrude as much as a set height.

In detail, the contact part 31 may form a rear surface of the adjusting member 30 and may form a surface facing a front surface of the cabinet 10 or the front surface of the top cover 14. Accordingly, when the door 20 is closed, the contact part 31 may contact the front surface of the cabinet 10 or the top cover 14.

An indicating part 311 capable of indicating a height of the adjusting member 30 in the mounting direction may be further formed on the contact part 31. The indicating part 311 may be formed as one or more protrusions or in groove shape and may be formed at predetermined gaps along the circumference of the contact part 31. The indicating part 311 is formed at a position corresponding to the adjusting part 36 to be described below, so that a height change according to the manipulation of the adjusting member 30 can be visualized.

For example, the height of the adjusting member 30 may be adjusted in four levels, and the indicating part 311 may be disposed to be rotated at an angle of 90° with respect to the center of the adjusting member 30. The indicating part 311 may indicate the manipulating height of the adjusting member 30 stepwise using the number of points. The indicating part 311 may protrude or be recessed to allow the user to visualize the currently set height of the gap adjusting device 50.

The circumferential part 32 extends toward the rear surface of the cap deco 25 and may be formed along the circumference of the contact part 31. Accordingly, the front surface of the adjusting member 30 may be opened, and the seating part 40 protruding from the rear surface of the cap deco 25 may be inserted. Further, although not illustrated in detail, a multi-stage adjusting part 36 capable of adjusting the height by contact with the seating part 40 may be formed inside the adjusting member 30.

A guide part 321 protruding outward may be formed on the circumferential part 32. The guide part 321 is visualized so that the adjusting member 30 can be mounted in an accurate position, and when the adjusting member 30 is mounted, the user may check the guide part 321 to determine the correct mounting position. The guide part 321 may be formed at a position corresponding to the indicating part 311.

For example, when the height of the adjusting member 30 is adjusted in four levels, the guide part 321 may be disposed to rotate at an angle of 90° with respect to the center of the adjusting member 30. When the adjusting member 30 is mounted to a desired height, the user may correctly mount the adjusting member 30 by making the corresponding guide part 321 face upward. In other words, accurate mounting of the adjusting member 30 may be induced by the indicating part 311 and the guide part 321.

Therefore, the user rotates the adjusting member 30 so that the indicating part 311 on which the desired height is indicted faces upward, and then mounts the adjusting member 30 on the seating part 40, and at this time, the adjusting member 30 is aligned with the seating part 40 so that the guide part 321 is perpendicular to the upper surface of the door 20 so that the adjusting member 30 is capable of being accurately mounted on the seating part 40.

Meanwhile, the seating part 40 may protrude rearward from the rear surface of the cap deco 25 and may be formed in a shape corresponding to the shape of the inner surface of the adjusting member 30. The seating part 40 may be in contact with the adjusting part 36 of the adjusting member 30 while being inserted into the adjusting member 30. When the adjusting member 30 is mounted, the position of the adjusting part 36 in contact with the seating part 40 is changed according to the rotational state of the adjusting member 30 and thus the protrusion height of the adjusting member 30 can be adjusted.

Hereinafter, the structure of the seating part 40 constituting the gap adjusting device 50 will be described in more detail with reference to the drawings.

Figure 8:
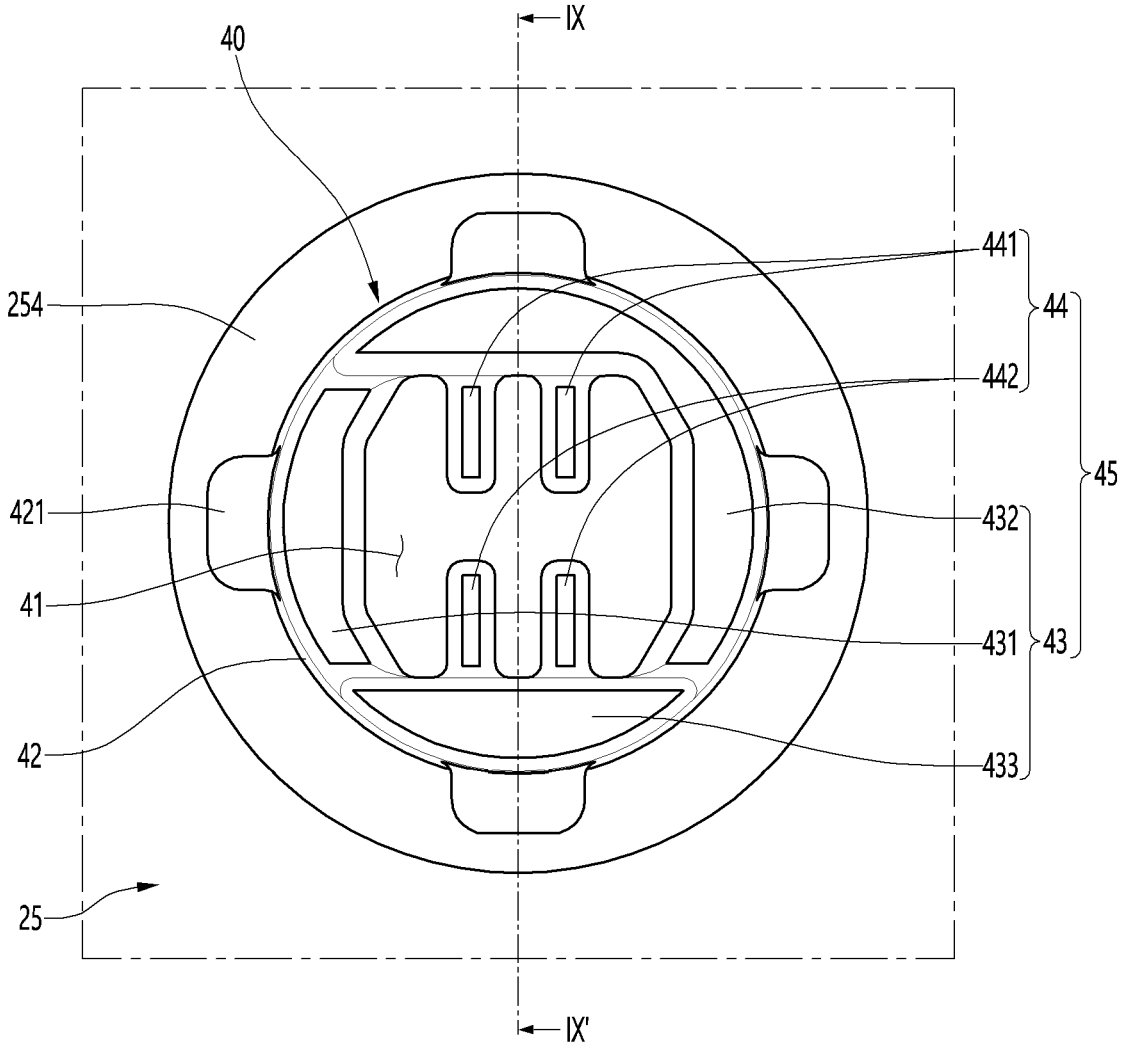
FIG. 8 front view of the structure of a seating part, which is one configuration of the gap adjusting device.
Figure 9:
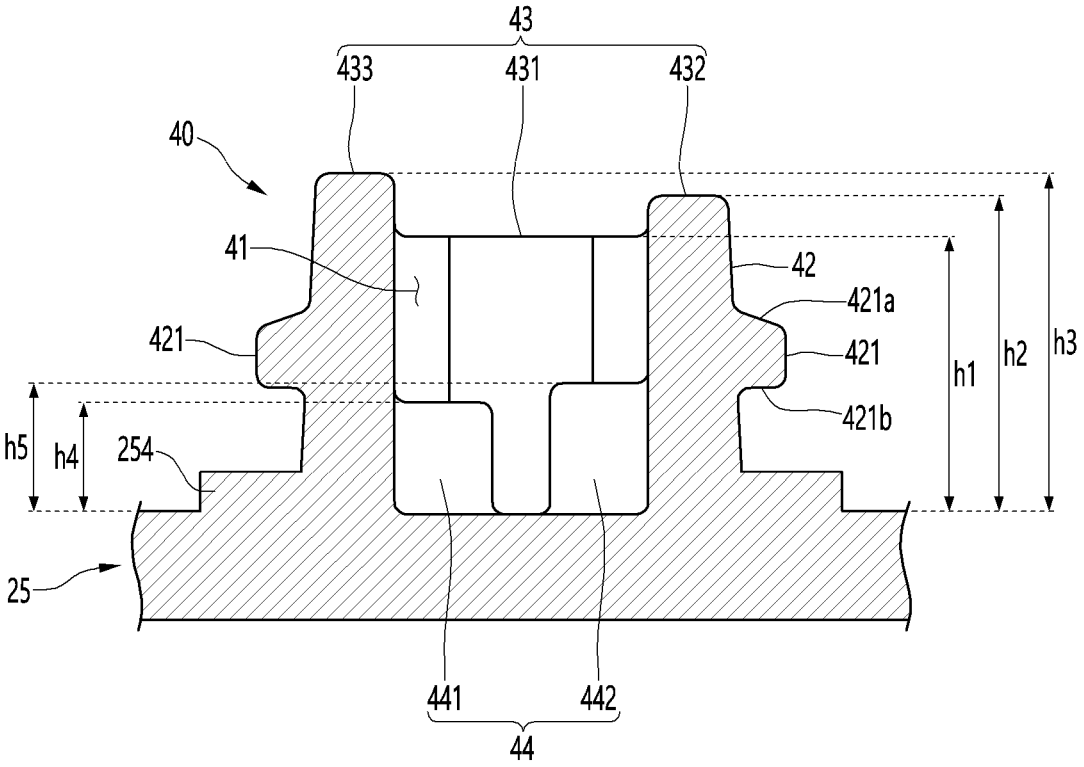
FIG. 9 is a cross-sectional view taken along line IX-IX' of FIG. 8.

FIG. 8 is a front view illustrating the structure of a seating part, which is one configuration of the gap adjusting device, and FIG. 9 is a cross-sectional view taken along line IX-IX' of FIG. 8.

As illustrated in the drawing, the seating part 40 may be formed to protrude from the rear surface of the door 20. The seating part 40 may be formed on the rear surface of the cap deco 25. The seating part 40 may protrude from the outside of the gasket 26.

Hereinafter, an example is described that the seating part 40 is formed on the cap deco 25, but the seating part 40 may be located at various positions on the rear surface of the door 20.

The seating part 40 may protrude from the rear surface of the cap deco 25 facing the front upper end of the cabinet 10 or the top cover 14. The seating part 40 may be integrally molded during injection molding of the cap deco 25 formed of a plastic material. However, also other attachments of the seating part on the rear side of the door are possible like adhesive attachment or a fixing element like a screw.

The seating part 40 may be formed such that a rear surface facing the adjusting member 30 is opened, and a recessed seating part space 41 may be formed inside the opened rear surface. In detail, the seating part 40 may be formed in a cylindrical shape with an opened rear surface and may have a corresponding size so that the seating part 40 can be inserted into the adjusting member space 300 formed in the opened front surface of the adjusting member 30.

The seating part 40 may include a seating part body 42 having a cylindrical shape. The seating part body 42 may be inserted into the adjusting member space 300. In this case, the seating part body 42 may be formed to be completely received inside the adjusting member space 300 in a state when the height of the adjusting member 30 is the lowest. An outer surface of the seating part body 42 may be in contact with an inner surface of the adjusting member space 300.

A seating part base 254 may be formed at a front end of the seating part body 42. The seating part base 254 may be formed along the circumference of the seating part body 42 and may protrude from the rear surface of the cap deco 25. When the adjusting member 30 is mounted to have height in the lowest state, the seating part base 254 may come into contact with the front end of the adjusting member 30.

Further, a fixing protrusion 421 protruding outward may be formed on an outer surface of the seating part body 42. The fixing protrusion 421 may protrude to be inserted into a fixing groove 332 formed on an inner surface of the adjusting member 30 while the adjusting member 30 is mounted on the seating part 40. A plurality of the fixing protrusions 421 may be formed at equal gaps along the circumference of the seating part body 42 and may be disposed at the same height at the extended end part of the seating part body 42.

For example, four fixing protrusions 421 may be formed and may be disposed in a state of being rotated at an angle of 90° with respect to the center of the seating part body 42, may be disposed in the same direction as the direction of the support part 45 formed on the seating part 40 so that even when the adjusting member 30 is mounted at various heights, it is possible to ensure a stable fixed state without being biased to one side. The fixing protrusion 421 may protrude outward from approximately the middle of the protrusion height of the seating part body 42.

Further, the fixing protrusion 421 may have an inclined surface 421*a* formed on a rear surface where contact with the adjusting member 30 starts when the adjusting member 30 is inserted. A constraining surface 421*b* extending perpendicularly to an outer surface of the seating part body 42 may be formed on the front surface of the fixing protrusion 421. Therefore, when the seating part 40 is inserted into the adjusting member space 300 when the adjusting member 30 is mounted, the front end of the adjusting member 30 is in contact with the inclined surface 421*a* so that insertion of the seating part 40 becomes easier, and in a state when the mounting of the adjusting member 30 is completed, the inner surface of the adjusting member 30 is engaged with the constraining surface 421*b*, and, it is possible to prevent the position of the adjusting member 30 from being changed or being separated from the seating part 40.

The seating part 40 may include a support part 45 on which the adjusting part 36 formed on the adjusting member 30 is seated. The height of the gap adjusting device 50 may be adjusted by a combination of contact surfaces of the adjusting part 36 and the support part 45.

The support part 45 may include a main support part 43 and a sub support part 44, and the main support part 43 and the sub support part 44 are in contact with the adjusting part 36 of the adjusting member 30, respectively and thus the protrusion height of the adjusting member 30 can be adjusted. At this time, the support part 45 may have at least two or more surfaces in contact with the adjusting member 30 and the gap adjusting device 50 to determine the protrusion height of the gap adjusting device 50. In particular, at least the support parts 45 disposed at positions facing each other support the adjusting part 36, respectively, so that the adjusting member 30 does not cause bias in one direction and it can be made to maintain a stable support state even when the door 20 is repeatedly opened and closed.

The support part 45 may include a main support part 43 formed at a protruding end portion of the seating part body 42, and a sub support part 44 protruding from the seating part space 41 inside the seating part body 42.

In detail, referring to FIG. 8, the main support part 43 is formed along the protruding upper end of the seating part body 42, wherein the main support part 43 may include a first main support part 431 formed on the left side of the seating part body 42, a second main support part 432 extending from the upper end of the first main support part 431 to the right and vertically extending downward from the extended end portion, and a third main support 433 vertically extending from the lower end of the second main support part 432 and connected to the lower end of the first main support part 431.

When looking at the seating part body 42 from the front, the seating part body 42 having the first main support part 431, the second main support part 432, and the third main support part 433 has an outer surface which is formed in a cylindrical shape and the inner surface which is formed in a polygonal shape.

The right ends of the first main support part 431 and the second main support part 432 are formed parallel to each other, and the upper ends of the third main support part 433 and the second main support part 432 may be formed to be parallel to each other.

The first main support part 431 may have the lowest protrusion height and may be stepped so that the heights of the second main support part 432 and the third main support 433 increase in order. For example, the first main support part 431 may protrude from the rear surface of the cap deco 25 to a height h1 of approximately 7 mm, and the second main support part 432 may protrude from the rear surface of the cap deco 25 to a height h2 of approximately 8 mm, and the third main support part 433 may protrude from the rear surface of the cap deco 25 to a height h3 of approximately 8.5 mm.

In other words, the heights of the plurality of main support parts 43 may increase stepwise each time the first main support part 43 rotates in the clockwise direction, and when rotated one turn (360°), the height can be returned to the original height.

Accordingly, when the adjusting member 30 is mounted, the protrusion height of the adjusting member 30 may be determined according to a rotation angle based on the center of the adjusting member 30. It may be possible to adjust the height of the adjusting member 30 stepwise according to a change in the rotation angle of the adjusting member 30.

At least one of the plurality of main support parts 43 may support the adjusting member 30 by contacting the main adjusting part 33 of the adjusting member 30 to be described below. In other words, the height of the gap adjusting device 50 may be adjusted according to the main support part 43 and the main adjusting part 33 that are in contact with each other.

Meanwhile, a plurality of sub support parts 44 may be formed inside the seating part 40, that is, inside the seating part space 41. The sub support part 44 is a part that is additionally in contact with the adjusting member 30, and the adjusting member 30 is not inclined and may maintain a more stable support state.

The sub support part 44 is in contact with the sub adjust part 34 to be described below and allows the adjusting member 30 to maintain a more stable support state without inclining or deviating from the position thereof.

Referring to FIG. 8, the sub support part 44 may include a first sub support part 441 provided on an inner lower surface of the seating part space 41, and a second sub support part 442 provided on the inner upper surface of the seating part space 41.

The first sub support part 441 and the second sub support part 442 may be formed at positions facing each other and may protrude in a direction facing each other from an inner surface of the seating part space 41. In this case, the first sub support part 441 may extend toward the upper side of the second main support part 432 at a position corresponding to the position of the third main support part 433. The second sub support part 442 may extend toward the right side of the second main support part 432 at a position corresponding to the position of the first main support part 431.

The first sub support part 441 and the second sub support part 442 may protrude from the bottom surface of the seating part space 41 to a predetermined height. The first sub support part 441 may be formed lower than the second sub support part 442.

For example, the first sub support part 441 may protrude to a height h4 of 2.8 mm with respect to the rear surface of the cap deco 25, and the second sub support part 442 can protrude to a height h5 of 3.3 mm from the rear. Accordingly, the first sub support part 441 and the second sub support part 442 may have a height difference of 0.5 mm.

Meanwhile, the first support part 441 and the second sub support part 442 may be formed of a pair of protrusions, respectively. The pair of first sub support parts 441 may have the same height and may be spaced apart from each other at equal gaps based on a longitudinal extension line passing through the center of the seating part. The second sub support part 442 may also be composed of a pair of protrusions having the same height as the first sub support part 441 and may be formed to face each other with the pair of first sub support parts 441.

Each of the first sub support part 441 and second sub support part 442 has a pair of protrusions spaced apart from each other to ensure a stable contact area with the sub adjust part 34. By forming the first sub support part 441 and the second sub support part 442, the injection-molded seating part 40 can be accurately molded without error.

Meanwhile, the seating part base 254 protruding along the circumference of the seating part body 42 may protrude to a height of approximately 1 mm with respect to the rear surface of the cap deco 25.

Hereinafter, the adjusting member 30 constituting the gap adjusting device 50 will be described in more detail with reference to the drawings.

Figure 10:
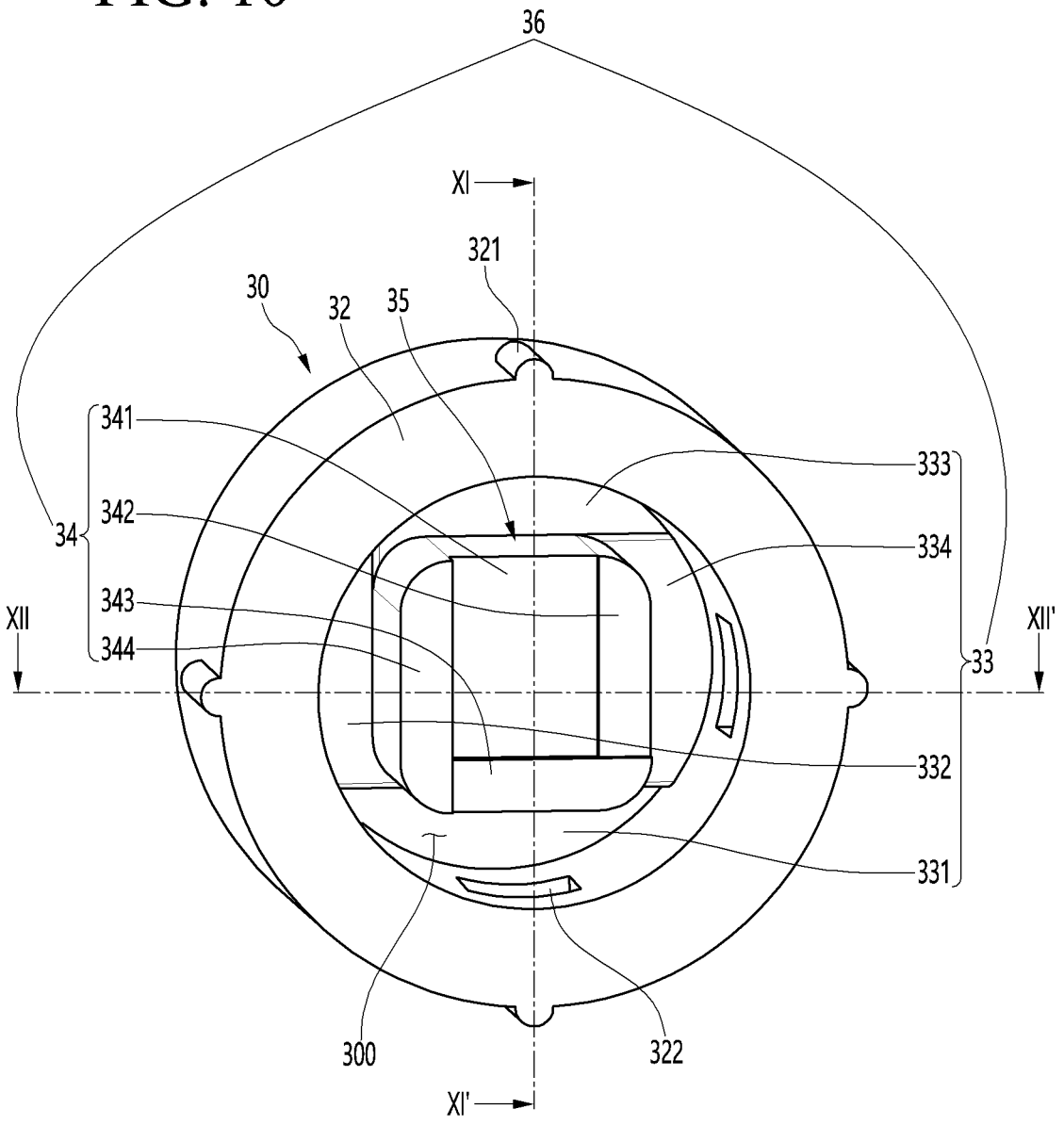
FIG. 10 is a perspective view illustrating an adjusting member, which is a component of the gap adjusting device, viewed from the rear.
Figure 11:
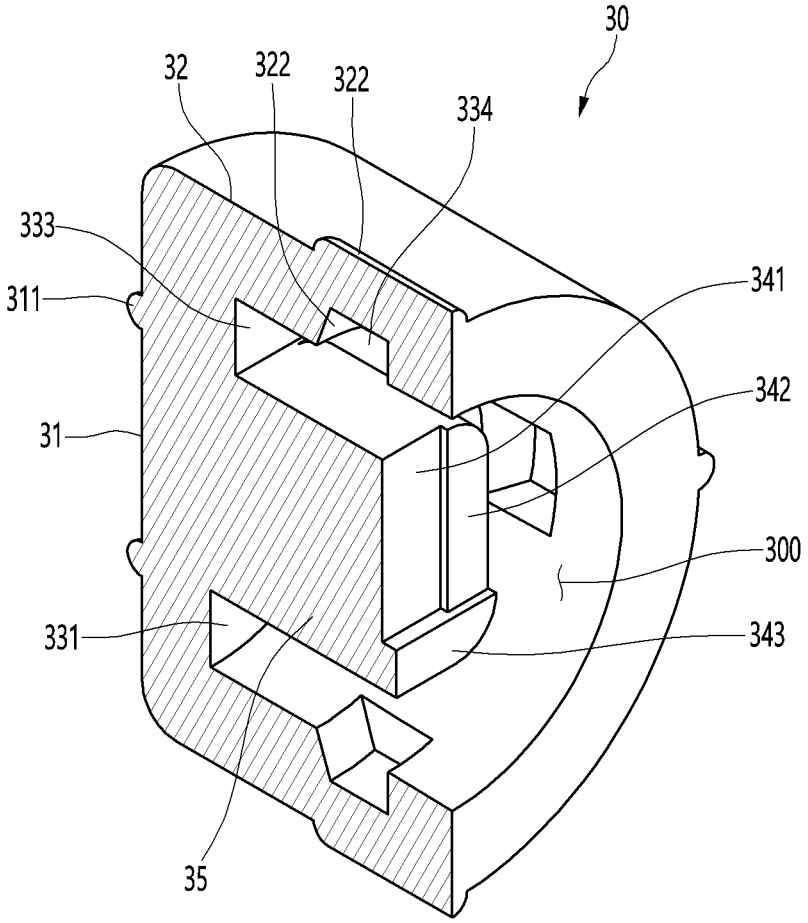
FIG. 11 is a cutaway perspective view taken along line XI-XI' of FIG. 10.
Figure 12:
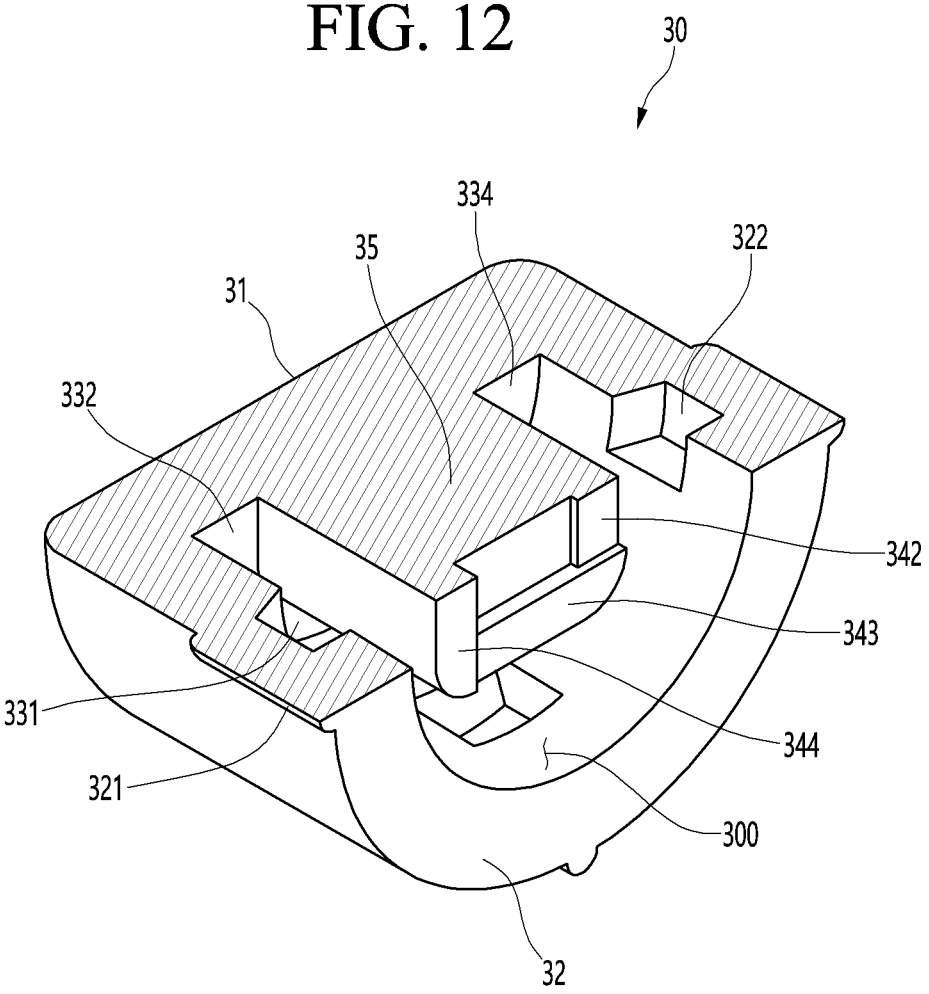
FIG. 12 is a perspective view taken along line XII-XII' of FIG. 10.

FIG. 10 is a perspective view illustrating an adjusting member, which is a component of the gap adjusting device, viewed from the rear, FIG. 11 is a cutaway perspective view taken along line XI-XI' of FIG. 10, and FIG. 12 is a perspective view taken along line XII-XII' of FIG. 10.

As illustrated in the drawing, the adjusting member 30 is formed in the cylindrical shape, and the outer shape thereof may be formed by the contact part 31 and the circumferential part 32. A plurality of indicating parts 311 may be formed to protrude from the contact part 31, and a plurality of guide parts 321 may be formed to protrude from the circumferential part 32.

An adjusting member space 300 that opens toward the front, that is, the seating part 40 may be formed inside the adjusting member 30. A protrusion part 35 may be formed inside the adjusting member space 300. The protrusion part 35 may be located in the center of the adjusting member space 300 and may protrude from the contact part 31.

A fixing groove 322 may be formed on an inner surface of the adjusting member space 300, that is, an inner surface of the circumferential part 32. The fixing groove 322 is coupled to the fixing protrusion 421 when the adjusting member 30 is mounted on the seating part 40 and may be recessed in a shape corresponding to the fixing protrusion 421.

For example, four fixing grooves 322 may be formed on an inner surface of the circumferential part 32 and may be arranged to rotate at an angle of 90° with respect to the center of the adjusting member 30. Accordingly, the adjusting member 30 may be mounted in a state rotated by 90° to the seating part, and the fixing protrusion 421 and the fixing groove 322 are coupled to each other so that the adjusting member 30 can maintain a state fixedly mounted to the seating part 40. The fixing grooves 322 may be configured in the same number as the guide parts 321 and may be disposed on the same extension line. The fixing groove 322 may be located on the same extension line as the guide part 321 as well as the adjusting part 36 and the indicating part 311. Therefore, in a state when the fixing groove 322 and the fixing protrusion 421 are coupled to each other and the adjusting member 30 is stably mounted, it may mean that the adjusting member 30 is mounted in an accurate height adjustment state.

The protrusion part 35 may have a polygonal cross-sectional shape, and the edge part thereof may have a rounded cross-sectional shape. In this case, the protrusion part 35 may be formed in a polygonal shape having a number of angles corresponding to the number of levels of height adjustment by the adjusting member 30. In this embodiment, the adjusting member 30 may have a four-level height adjustment structure, and thus the protrusion part 35 may have a quadrilateral cross-sectional shape.

The protrusion part 35 may be formed in a shape corresponding to the seating part space 41. Accordingly, in the state when the adjusting member 30 is mounted, the protrusion part 35 may be inserted into the seating part space 41 and may be in contact with the inner surface of the seating part 40. In a state when the adjusting member 30 is mounted, the circumferential part 32 may be in contact with the outer surface of the seating part 40. Accordingly, in a state when the adjusting member 30 and the seating part 40 are mounted, the adjusting member 30 and the seating part 40 can maintain a solid coupling state so that the adjusting member 30 and the seating part 40 are not shaken, arbitrarily separated or rotated even when the door 20 is repeatedly opened and closed.

Meanwhile, the adjusting member 30 may include an adjusting part 36. The adjusting member 30 may be supported by the adjusting part 36 by contact with the support part 45, and the protrusion height of the gap adjusting device 50 may be adjusted according to the position of the contacting support part 45.

The adjusting part 36 may be formed inside the adjusting member space 300 and may include the main adjusting part 33 in contact with the main support part 43, and the sub adjusting part 34 in contact with the sub support part 44.

The main adjusting part 33 may be formed on the inner surface, that is, the front surface of the contact part 31, may be located in the outside of the sub adjusting part 34, and may be located in the rear of the sub adjusting part 34 based on the center of the adjusting member 30. The main adjusting part 33 may be formed at a position corresponding to the protruding end portion of the main support part 43 when the adjusting member 30 is mounted.

In detail, the main adjusting part 33 is formed between the circumferential part 32 and the protrusion part 35 and may be formed in multiple stages in the rotational direction around the protrusion part 35. Further, the main adjusting part 33 may be formed at a position facing the main support part 43 when the adjusting member 30 is mounted on the seating part 40.

In detail, referring to FIG. 10, the main adjusting part 33 may include a first main adjusting part 331 formed below the protrusion part 35, a second main adjusting part 332 formed on the left side of the protrusion part 35, a third main adjusting part 333 formed above the protrusion part 35, and a fourth main adjusting part 334 formed on the right side of the projection part 35.

The first main adjusting part 331 forms the inner surface of the contact part 31, that is, the same plane as the front surface and has the lowest height among the main adjusting parts 33. The second main adjusting part 332 may extend upwardly crossing the first main adjusting part 331 by a 90° angle from the left end of the first main adjusting part 331 and may be formed one level higher than the first main adjusting part 331. The third main adjusting part 333 may extend from the upper end of the second main adjusting part 332 to the right side crossing the second main adjusting part 332 by a 90° angle and may be formed one level higher than the second main adjusting part 332. The fourth main adjusting part 334 may extend downwardly crossing the third main adjusting part 333 by a 90° angle from the right end of the third main adjusting part 333, and the end portion thereof may be formed to be connected to the right end of the first main adjusting part 331. The fourth main adjusting part 334 may be formed one level higher than the third main adjusting part 333.

For example, the first main adjusting part 331, the second main adjusting part 332, the third main adjusting part 333, and the fourth main adjusting part 334 each may be formed to increase in height by approximately 0.25 mm stepwise. Accordingly, the protrusion height of the gap adjusting device 50 can be adjusted stepwise according to the combination of the contact surface of the main adjusting part 33 and the main support part 43.

Meanwhile, the protrusion part 35 may be disposed so as to be surrounded by the main adjusting parts 33 and may protrude toward the opened front of the adjusting member 30. The sub adjusting part 34 may be formed on the protruding end portion, that is, the front surface of the protruding part 35.

Therefore, when the adjusting member 30 is mounted on the seating part 40, the sub adjusting part 34 formed at the end portion of the protruding part 35 can be supported by the sub support part 44 inside the adjusting member space 41. Further, the adjusting member 30 may maintain a more stable support state due to the contact between the sub support part 44 and the sub adjusting part 34.

In detail, the sub adjusting part 34 is formed so that the protrusion part 35 can be inserted into the seating part space 41 when the adjusting member 30 is mounted. In this case, the protrusion part and the seating part space may be formed in a shape corresponding to each other and may be formed in a polygonal shape to maintain a coupled state with each other. Therefore, even if impact is applied to the adjusting member 30 when the door 20 is closed, the adjusting member 30 can maintain a stable mounting state without changing or separating from the mounting position.

The sub adjusting part 34 has a structure supported by the sub support part 44, so that the sub adjusting part 34 may be an auxiliary support means if the stable state is not secured because the main adjusting part 33 and the main support part 43 according to the mounting state of the adjusting member 30 are not supported at the positions facing each other.

Each of the sub adjusting part 34 may be formed along an extended end portion of the protrusion part 35, that is, a circumference of the front surface, and each of the sub adjusting parts 34 may have different heights from each other. In other words, the sub adjusting part 34 may additionally support the adjusting member 30 when the main support part 43 and the main adjusting part 33 having different heights from each other are rotated to each other and mounted.

The sub adjusting part 34 may be located further rearward than the main adjusting part 33 as a whole and may be located inside a space surrounded by the main adjusting parts 33. The sub adjusting part 34 may include a first sub adjusting part 341, a second sub adjusting part 342, a third sub adjusting part 343, and a fourth sub-adjustment part 344 formed along the front circumference of the protrusion part 35.

In detail, referring to FIG. 10, the first sub adjusting part 341 may be formed at a position corresponding to the upper surface of the protrusion part 45 and may be formed at a position corresponding to the third main adjusting part 333. The first sub adjusting part 341 may have the lowest height among the sub adjusting parts 34. The protrusion height of the first sub adjusting part 341 may be formed to correspond to a height difference between the second main support part 432 and the second sub support part 442.

The second sub adjusting part 342 may extend downward crossing by a 90° angle from the right end of the first sub adjusting part 341 and may be formed one level higher than the first sub adjusting part 341. The third sub adjusting part 343 may extend in a left direction crossing by a 90° angle from the lower end of the second sub adjusting part 342 and may be formed to be one level higher than the second sub adjusting part 342. The fourth sub adjusting part 344 may extend upwardly crossing by a 90° angle from the left end portion of the third sub adjusting part 343, and the end portion thereof can be formed to be connected to the left end of the first sub adjusting part 341. The fourth sub adjusting part 344 may be formed one level higher than the third sub adjusting part 343.

For example, the sub adjusting part 34 may protrude by 5.2 mm from the front surface of the contact part 31, that is, the first main adjusting part 331. The first sub adjusting part 341, the second sub adjusting part 342, the third sub adjusting part 343, and the fourth sub adjusting part 344 each can be formed to increase in height by approximately 0.25 mm stepwise. In other words, the height difference between the sub adjusting parts 34 may be configured to correspond to the height difference between the sub support parts 44.

Hereinafter, a state when the adjusting member 30 is mounted on the seating part 40 will be described in more detail with reference to the drawings.

Figure 13:
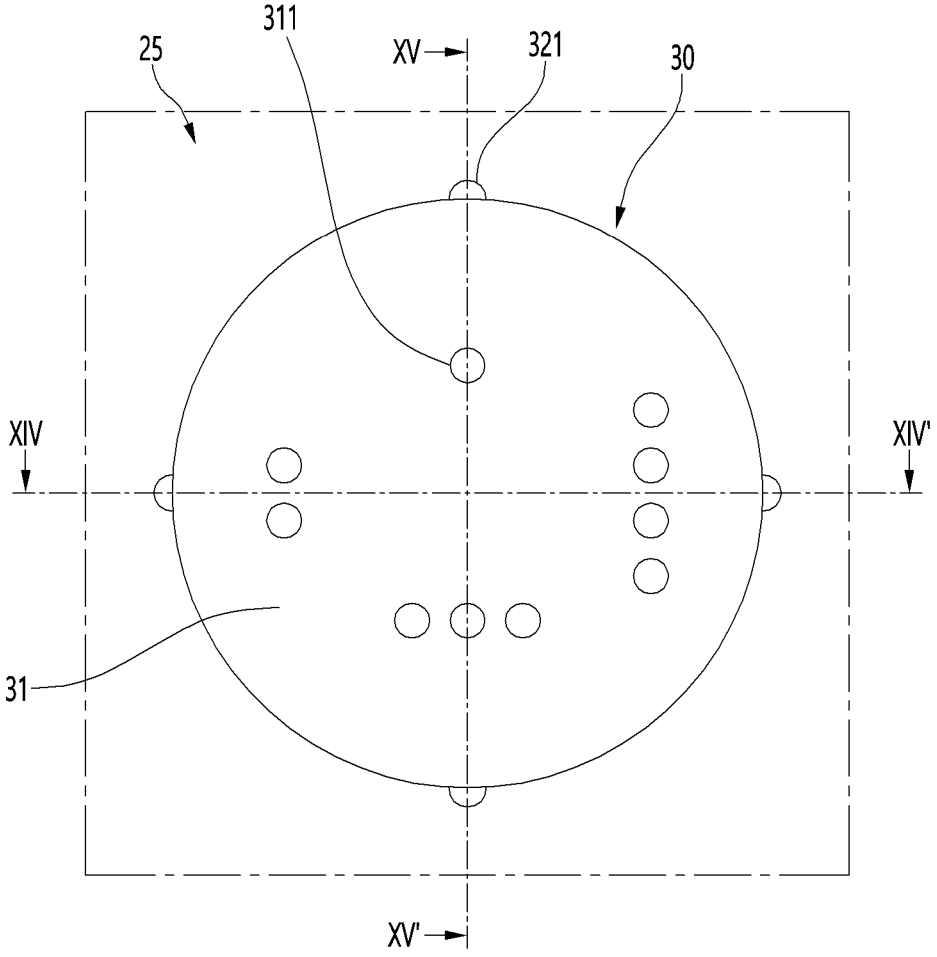
FIG. 13 rear view illustrating a state when the gap adjusting device is adjusted to a first level height.
Figure 14:
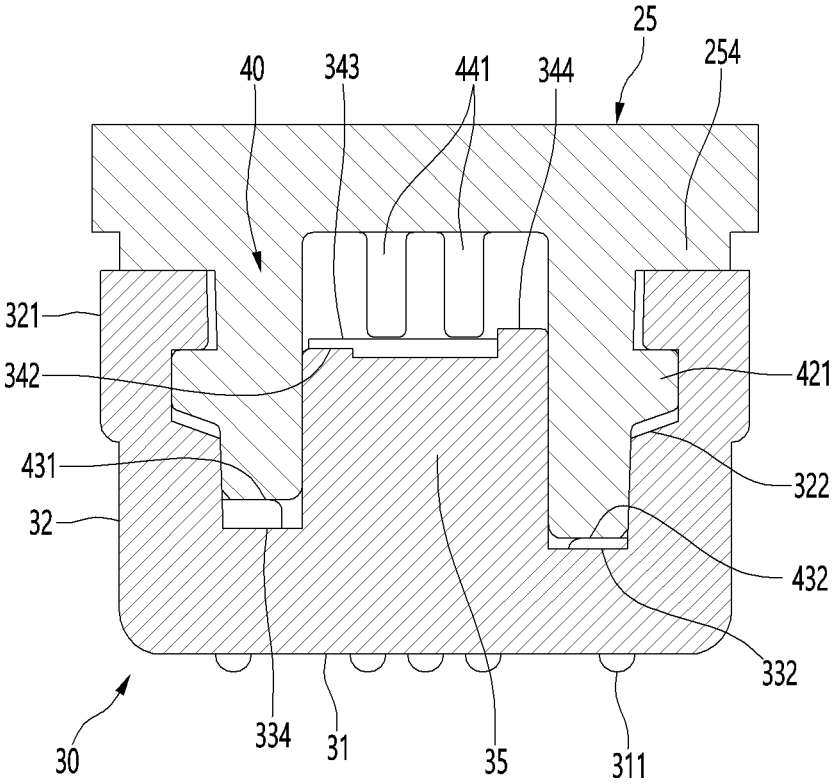
FIG. 14 is a cross-sectional view taken along line XIV-XIV' of FIG. 13.
Figure 15:
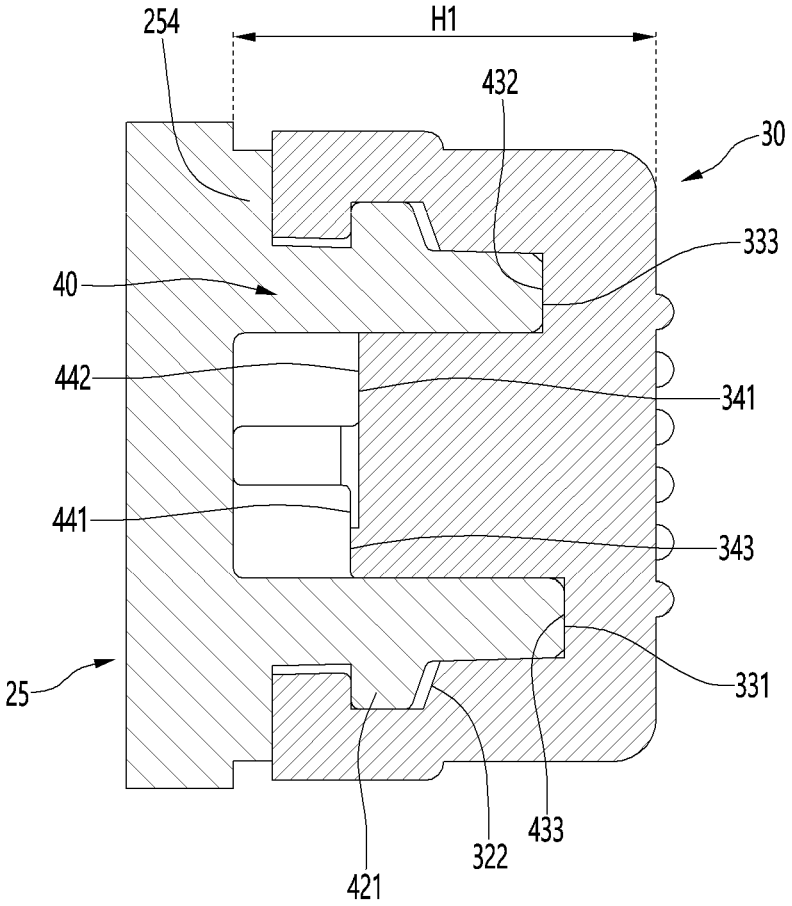
FIG. 15 is a cross-sectional view taken along line XV-XV' of FIG. 13.
Figure 16:
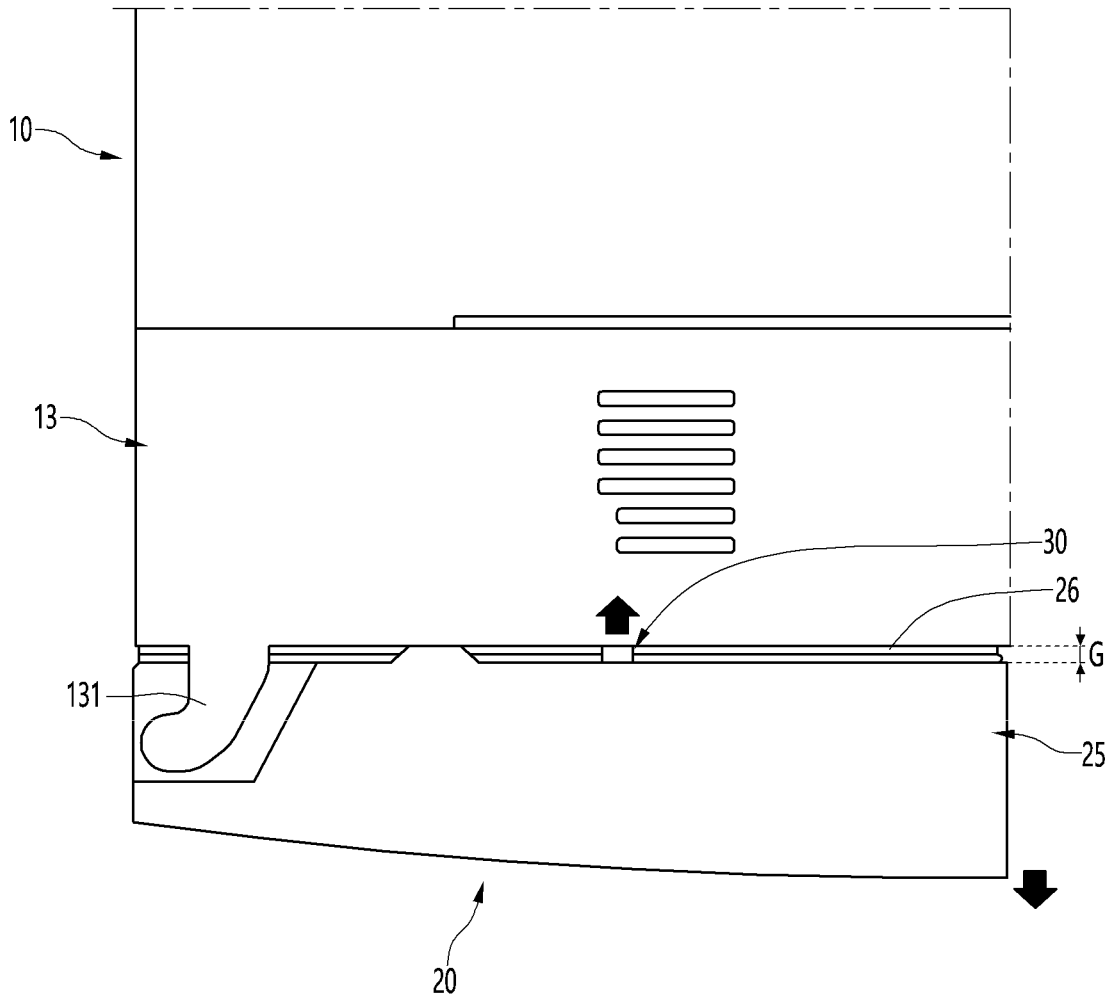
FIG. 16 is a partial plan view of a state of adjusting the gap of the door by the gap adjusting device.

FIG. 13 is a rear view illustrating a state when the gap adjusting device is adjusted to a first level height, FIG. 14 is a cross-sectional view taken along line XIV-XIV' of FIG. 13, FIG. 15 is a cross-sectional view taken along line XV-XV' of FIG. 13, and FIG. 16 is a partial plan view illustrating a state of adjusting the gap of the door by the gap adjusting device.

As illustrated in the drawings, the adjusting member 30 may be mounted on the seating part 40, and at this time, the adjusting member 30 may be mounted on the seating part 40 in a state when the direction of the adjusting member 30 is aligned to the correct position through the indicating part 311 and the guide part 321.

The user inserts the adjusting member 30 into the seating part 40 in a state of aligning the adjusting member so that the indicating part 311 on which the first level height H1 is indicated among the plurality of indicating parts 311 and the guide part 321 corresponding thereto faces upward.

At this time, the protrusion part 35 of the adjusting member 30 may be inserted into the seating part space 41, and the seating part body 42 may be inserted into the adjusting member space 300. When the adjusting member 30 is correctly aligned, the fixing protrusion 421 and the fixing groove 322 may be coupled to each other, and the adjusting member 30 can be in a state of being firmly coupled to the seating part 40.

In this state, the height H1 of the gap adjusting device 50 may be the lowest among the heights of the adjustable gap adjusting device 50. For example, as illustrated in FIG. 15, at the first level height H1, a height of approximately 10.5 mm may be obtained from the rear surface of the door 20 to the rear end of the gap adjusting device 50.

In a state when the adjusting member 30 is mounted, the protrusion part 35 is inserted into the seating part space 41 to maintain a stable mounting state. At this time, the protrusion part 35 is disposed inside the seating part space 41 having the same cross-sectional structure to maintain a stable mounting state without causing flowing or deviating from the mounting position. In particular, it is possible to maintain a more rigid mounting state by the fixing protrusion 421 and the fixing groove 322, and it is possible to ensure maintenance of an accurate height adjustment level.

The adjusting part 36 and the support part 45 as a whole have a stable support structure in contact with each other. In detail, the third main support part 433 positioned at the lower side of the support part 45 is in contact with the first sub adjusting part 341. The second main support part 432 positioned above the third main support part 433 may be in contact with the third main adjusting part 333.

The first sub support part 441 is in contact with the third sub adjusting part 343, and the second sub support part 442 is supported in contact with the first sub adjusting part 341.

In this way, the adjusting part 36 and the support part 45 have a structure that supports each other at the upper and lower positions that are opposite to each other. Therefore, even if impact or load is applied to the contact part 31 at an eccentric position, the adjusting member 30 can be maintained without deviating from the mounting position.

The first main support part 431 and the second main support part 432 disposed on both left and right sides may be spaced apart from the second main adjusting part 332 and the fourth main adjusting part 334 from each other. The second sub adjusting part 342 and the fourth sub adjusting part 344 may also be in a state when the first sub support part 441 and the second sub support part 442 are not in contact.

When the door 20 is closed while the gap adjusting member 30 is adjusted to the height H1 of the first level, the contact part 31 is in contact with the front surface of the cabinet 10 or the front surface of the top cover 14, and thus rotation of closing the door 20 may be stopped. In this case, the gasket 26 may be attached to the front surface of the cabinet 10 by the magnetic force of the magnet 261 therein, and the portion between the cabinet 10 and the door 20 may be sealed.

Meanwhile, the gap adjusting member 30 may be located at an approximately intermediate point of the length of the door 20 in the transverse direction. Accordingly, when the protrusion height H1 of the gap adjusting member 30 is adjusted to 10.5 mm, the gap G between the door 20 and the cabinet 10 may be also equally adjusted. In other words, the gap G between the rear surface of the door 20 and the cabinet 10 may be adjusted to 10.5 mm.

Meanwhile, in such a state, when since the height of the front surface of the door 20 is low, there is a step between the front surface of the door and the front surfaces of other adjacent doors 20 or home appliance, the front surface of furniture or wall O, the protrusion height of the gap adjusting device 50 can be adjusted.

In order to adjust the protrusion height of the gap adjusting device 50, the door 20 may be first opened so that the adjusting member 30 is exposed. By pulling the adjusting member 30 in a mounted state, the adjusting member 30 may be separated from the seating part 40. When the adjusting member 30 is strongly pulled rearward, the fixing protrusion 421 and the fixing groove 322 may be separated from each other by elastic deformation of the adjusting member 30, and the adjusting member 30 may be separated from the seating part 40.

Then, the user can accurately mount the adjusting member 30 on the seating part 40 again while the indicating part 311 having a desired height is disposed to face upward. Before the adjusting member 30 is mounted, the protrusion height of the gap adjusting device 50 may be adjusted stepwise according to an angle at which the user rotates the adjusting member 30.

Hereinafter, with reference to the drawings, a state when the protrusion height of the gap adjusting device is adjusted will be described in more detail.

Figure 17:
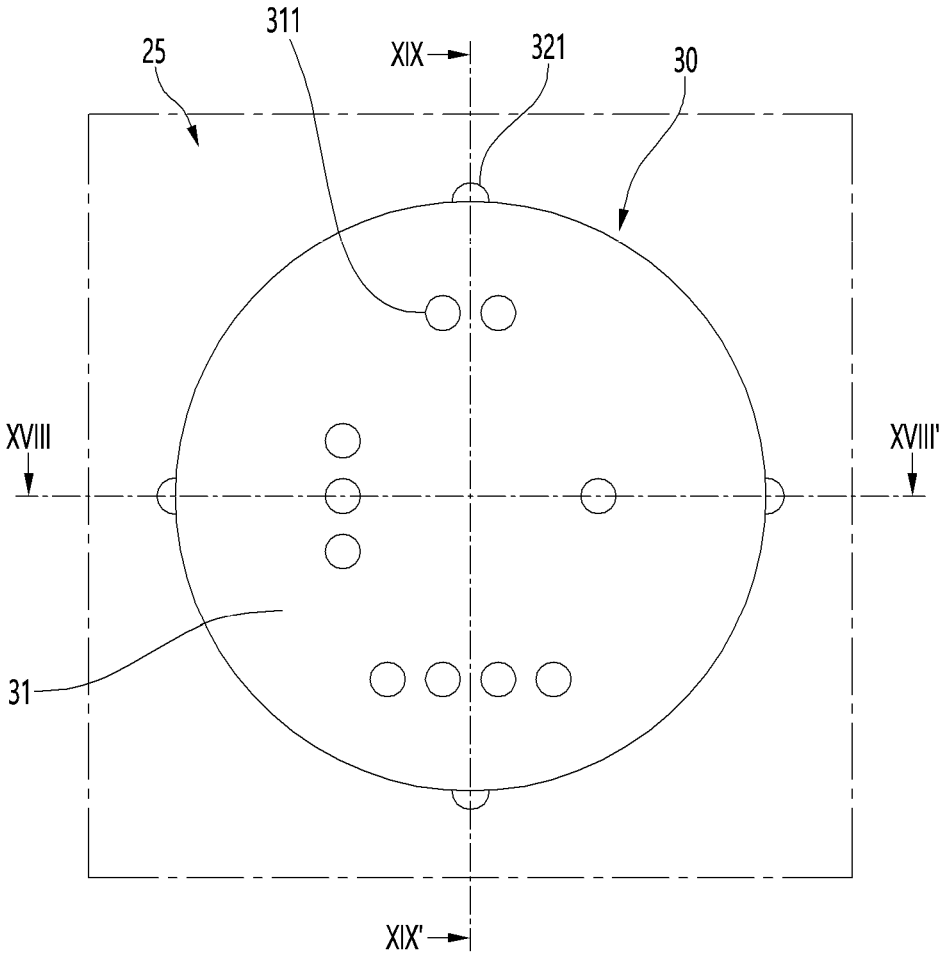
FIG. 17 is a rear view of a state when the gap adjusting device is adjusted to a second level height.
Figure 18:
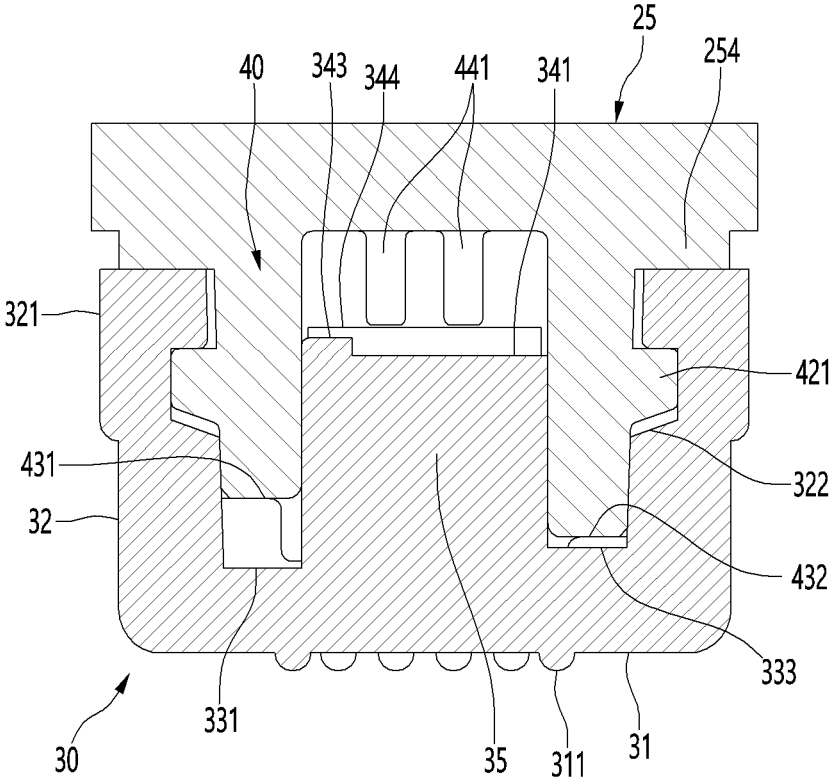
FIG. 18 is a cross-sectional view taken along line XVIII-XVIII' of FIG. 17.
Figure 19:
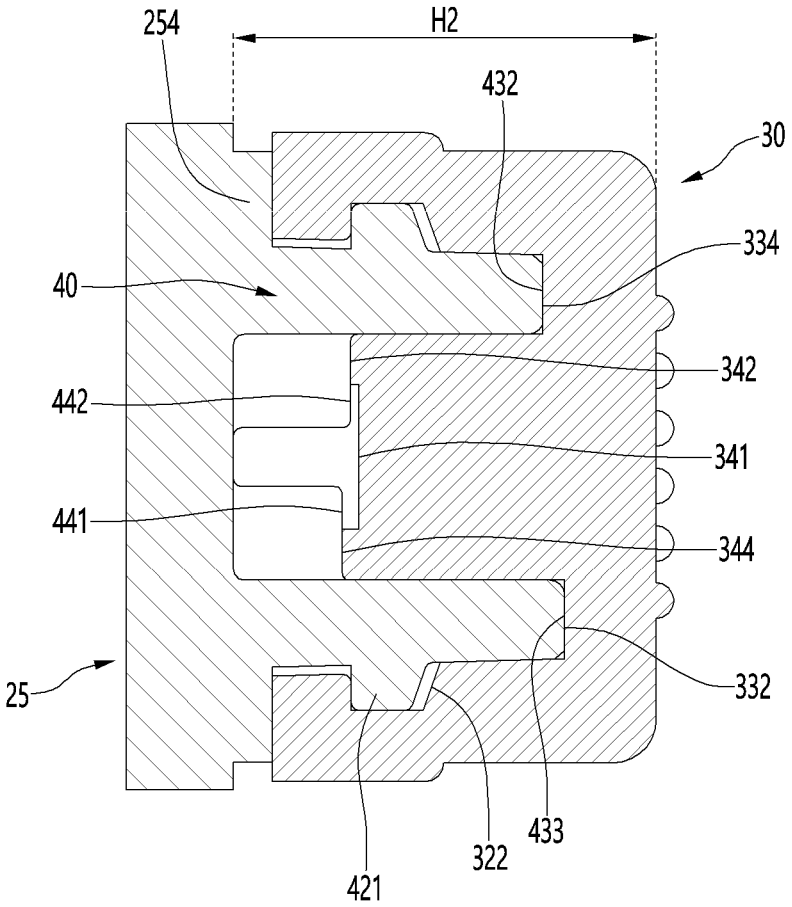
FIG. 19 is a cross-sectional view taken along line XIX-XIX' of FIG. 17.

FIG. 17 is a rear view illustrating a state when the gap adjusting device is adjusted to a second level height, FIG. 18 is a cross-sectional view taken along line XVIII-XVIII' of FIG. 17, and FIG. 19 is a cross-sectional view taken along line XIX-XIX' of FIG. 17.

As illustrated in the drawing, when the user rotates the adjusting member 30 by 90° counterclockwise based on FIG. 13 while the adjusting member 30 is separated and then is mounted, as illustrated in FIGS. 17 to 19, the gap adjusting device 50 can be manipulated to have a second level height.

For example, at the second level height H2, a height of about 11 mm may be obtained from the rear surface of the door 20 to the rear end of the gap adjusting device 50. In other words, it can be seen that the height H2 of the gap adjusting device 50 increases by one level (0.5 mm) compared to the first step height H1. Meanwhile, the gap adjusting device 50 may be located at the midpoint of the transverse length of the door 20, and thus, when the height of the gap adjusting device 50 increases by 0.5 mm, the gap G of the end portion of the door 20 can be increased by 1 mm. In other words, the effect of adjusting the protrusion height of the door 20 may increase through fine adjustment of the gap adjusting device 50.

Looking in more detail at the state when the gap adjusting device 50 is adjusted to the second level height, the fourth main adjusting part 334 and the second adjusting part 342 of the adjusting part 36 are positioned on the upper side by the mounting after rotation of the adjusting member 30. The fourth main adjusting part 334 and the second sub adjusting part 342 are in a state of being in contact with the second main support part 432 and the second sub support part 442 of the support part 45 positioned on the upper side, respectively and thus being supported.

The second main adjusting part 332 and the fourth sub adjusting part 344 of the adjusting part 36 are positioned at the lower side by mounting after rotation of the gap adjusting device 50. The second main adjusting part 332 and the fourth sub adjusting part 344 are respectively are in contact with the third main support part 433 and the first sub support part 441 of the support part 45 located at the lower side, respectively.

In this way, the adjusting part 36 and the support part 45 have a structure that supports each other at the upper and lower positions that are opposite to each other. Therefore, even if impact or load is applied to the contact part 31 at an eccentric position, the adjusting member 30 can be maintained without deviating from the mounting position.

The first main support part 431 and the second main support part 432 disposed on both left and right sides may be in a state spaced apart from the first main adjusting part 331 and the third main adjusting part 333. The first sub adjusting part 341 and the third sub adjusting part 343 may not be in contact with the first support part 441 and second sub support part 442.

When compared with the first step height H1 of FIGS. 13 to 15, the position of the adjusting part 36 supported by the seating part 40 by mounting after the adjusting member is rotated by 90° may be changed to a second main adjusting part 332, fourth main adjusting part 334, second sub adjusting part 342 and fourth sub adjusting part 344 which have a higher level of height. Accordingly, the gap G between the rear surface of the door 20 and the cabinet 10 increases, and the front surface of the door 20 can further protrude.

At this time, when the gap adjusting device 50 is mounted, the user can check the second level height H2 by placing the indicating part 311 consisting of two protrusions on the upper side, and by allowing the corresponding guide part 321 to be positioned upward, the adjusting member 30 is accurately inserted and mounted in the seating part 40, so that it is possible to adjust to the desired correct height.

Figure 20:
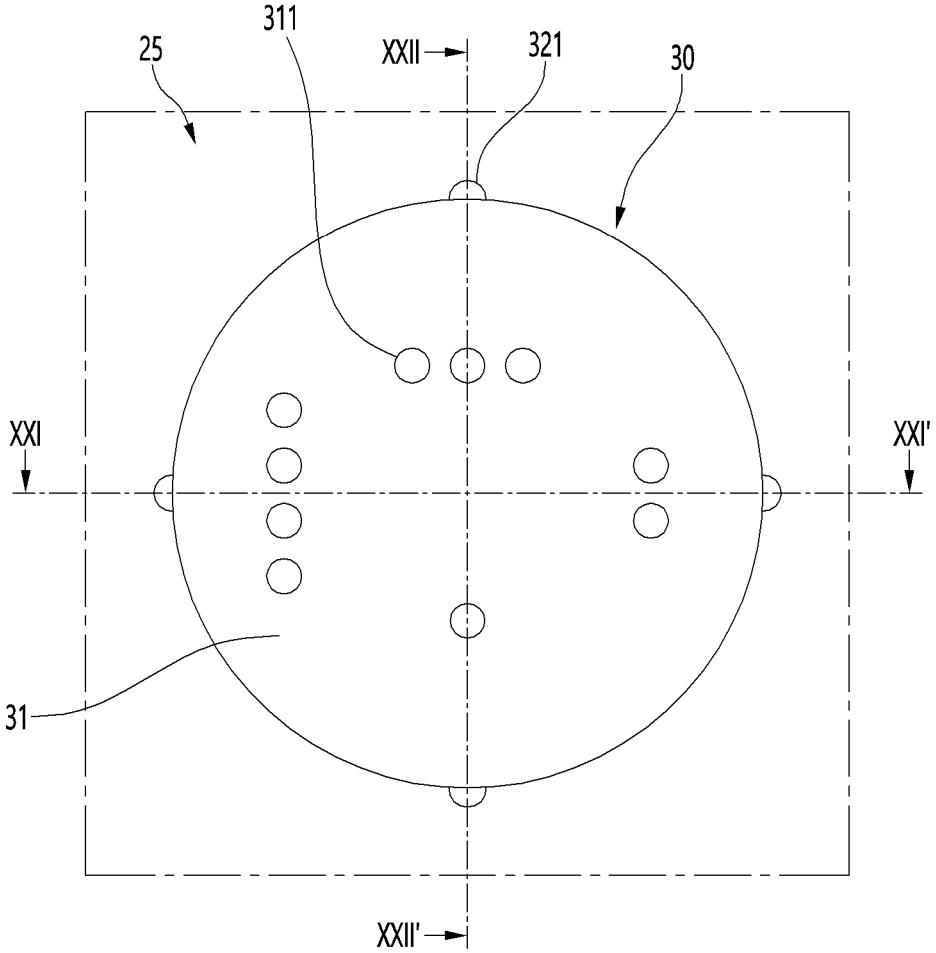
FIG. 20 is a rear view of a state when the gap adjusting device is adjusted to a third level height.
Figure 21:
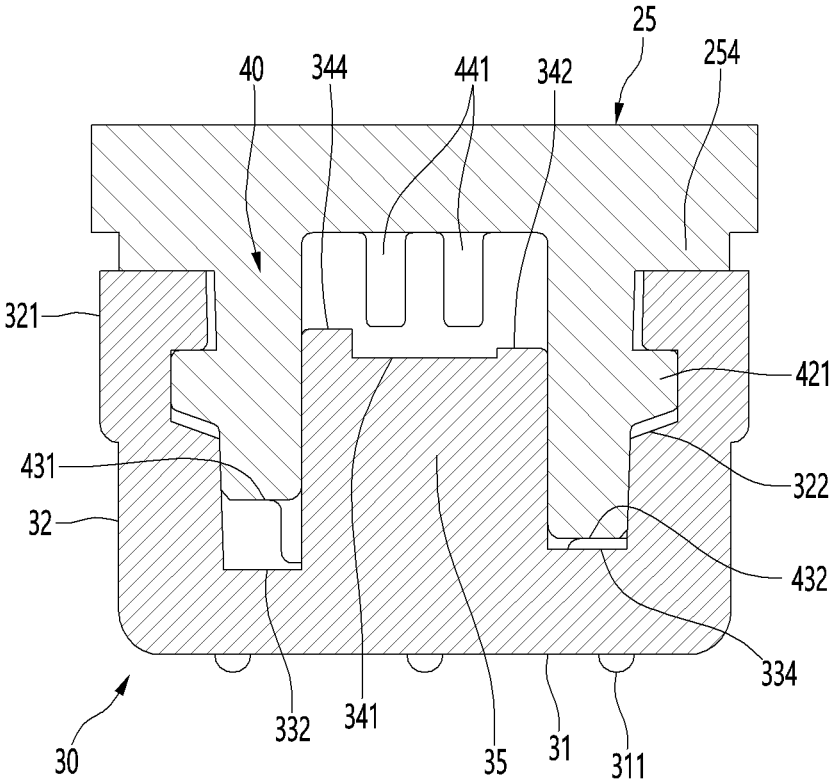
FIG. 21 is a cross-sectional view taken along line XXI-XXI' of FIG. 20.
Figure 22:
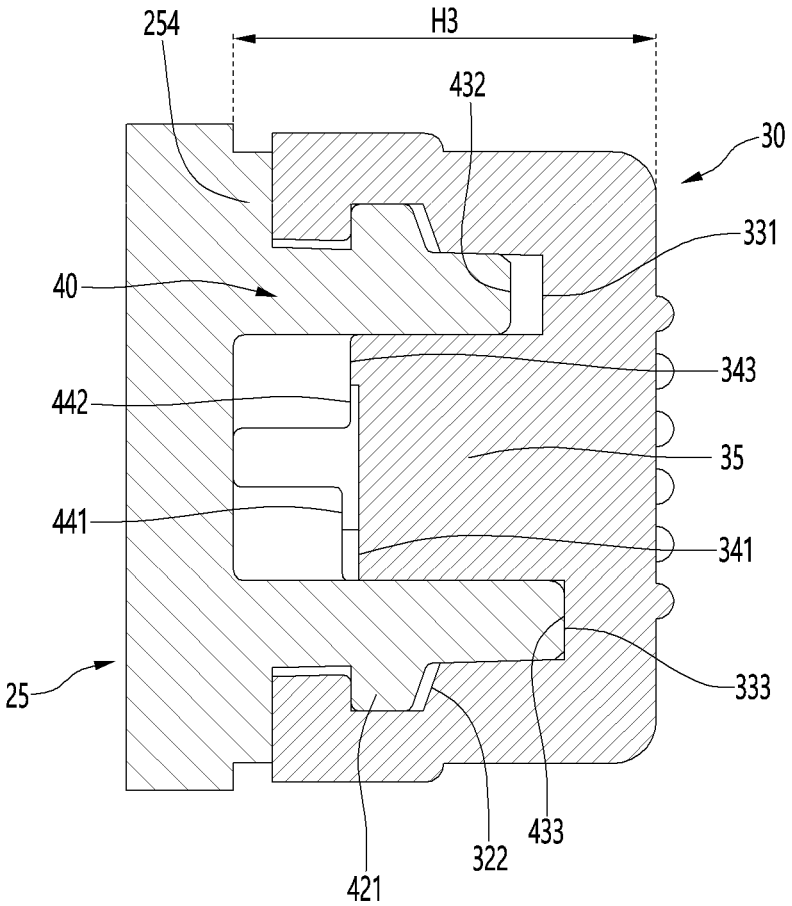
FIG. 22 is a cross-sectional view taken along line XXII-XXII' of FIG. 20.

FIG. 20 is a rear view illustrating a state when the gap adjusting device is adjusted to a third level height, FIG. 21 is a cross-sectional view taken along line XXI-XXI' of FIG. 20, and FIG. 22 is a cross-sectional view taken along line XXII-XXII' of FIG. 20.

As illustrated in the drawings, when the user rotates the adjusting member 30 by 180° counterclockwise based on FIG. 13 while the adjusting member 30 is separated and then mounts the adjusting member 30, as illustrated in FIGS. 20 to 22, the gap adjusting device 50 can be manipulated to have a third level height.

For example, in the third level height H3, a height of approximately 11.5 mm may be obtained from the rear surface of the door 20 to the rear end of the gap adjusting device 50. In other words, it can be seen that the height H3 of the gap adjusting device 50 increases by one level (0.5 mm) compared to the second level height H2. Meanwhile, the gap adjusting device 50 may be located at the midpoint of the transverse length of the door 20, and thus, when the height of the gap adjusting device 50 increases by 0.5 mm, the gap G of the end portion of the door 20 can increases by 1 mm.

Looking in more detail at the state when the gap adjusting device 50 is adjusted to the third level height, the first main adjusting part 331 and the third adjusting part 343 are positioned on the upper side of the adjusting part 36 by mounting after the rotation of the adjusting member 30. The first main adjusting part 331 may be in a state of being spaced apart from the first main support part 431, and the third sub adjusting part 343 is in a state of being supported by being in contact with the second sub support part 442, respectively.

The third main adjusting part 333 and the first sub adjusting part 341 of the adjusting parts 36 are positioned on the lower side by mounting after rotation of the gap adjusting device 50. The third main adjusting part 333 is in contact with the third main support part 433, and the first sub adjusting part is spaced apart from the first sub support part 441.

In this way, the adjusting part 36 and the support part 45 have a structure that supports each other at the upper and lower positions that are opposite to each other. Therefore, even if impact or load is applied to the contact part 31 at an eccentric position, the adjusting member 30 can be maintained without deviating from the mounting position.

The first main support part 431 and the second main support part 432 disposed on both left and right sides may be spaced apart from the second main adjusting part 332 and the fourth main adjusting part 334 from each other. The second sub adjusting part 342 and the fourth sub adjusting part 344 may also be in a state when the first sub support part 441 and the second sub support part 442 are not in contact.

Compared with the second level height H2 of FIGS. 17 to 19, the position of the adjusting part 36 supported by the seating part 40 by mounting after the adjusting member 30 rotates by 90° may be changed to a third main adjusting part 333 and a second sub adjusting part 342 which are one level higher. Accordingly, the gap G between the rear surface of the door 20 and the cabinet 10 increases, and the front surface of the door 20 can be further protruded.

At this time, when the gap adjusting device 50 is mounted, the user can check the third level height H3 by placing the indicating part 311 consisting of three protrusions on the upper side, and the adjusting member 30 is accurately inserted and mounted in the seating part 40 by allowing the corresponding guide part 321 to be positioned upward, so that it is possible to adjust to the desired correct height.

Figure 23:
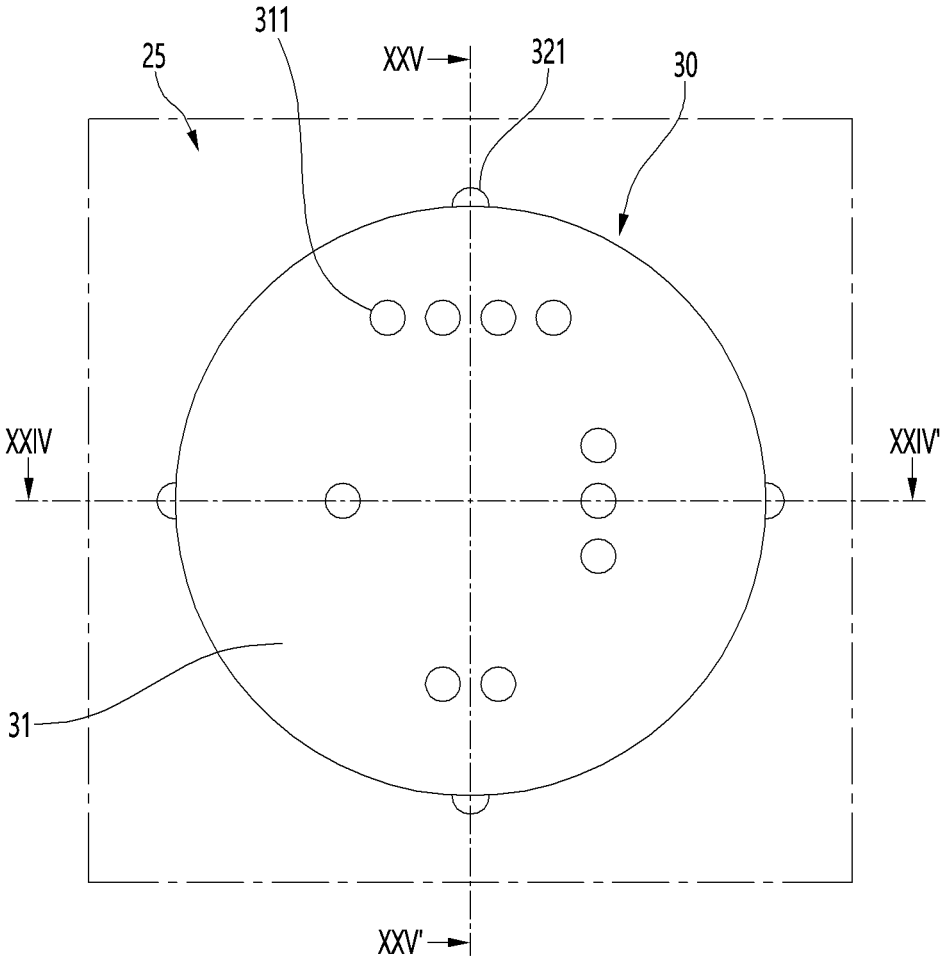
FIG. 23 is a rear view of a state when the gap adjusting device is adjusted to a fourth level height.
Figure 24:
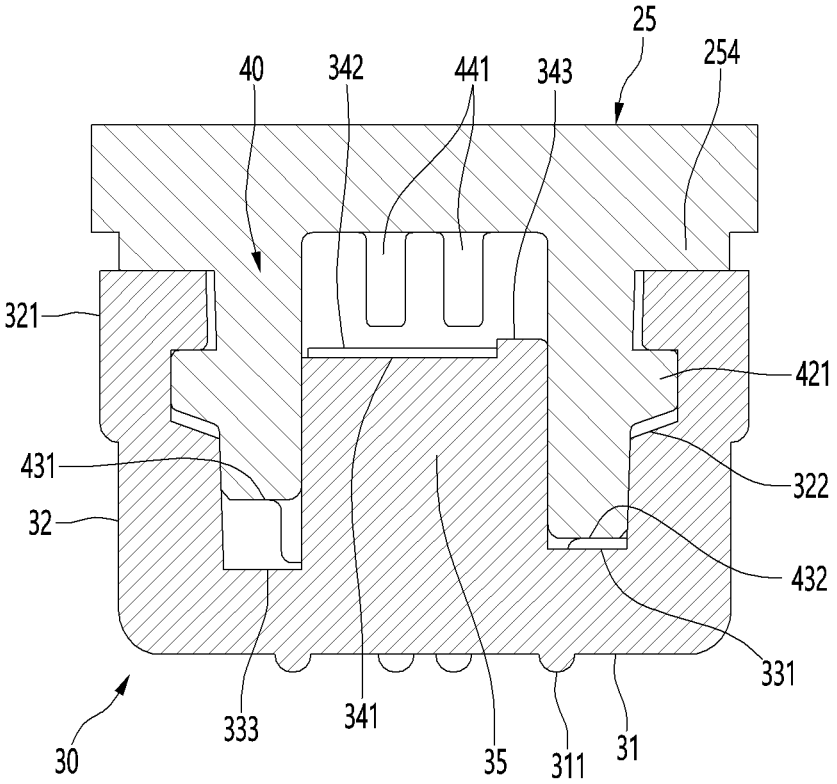
FIG. 24 is a cross-sectional view taken along line XXIV-XXIV' of FIG. 23.
Figure 25:
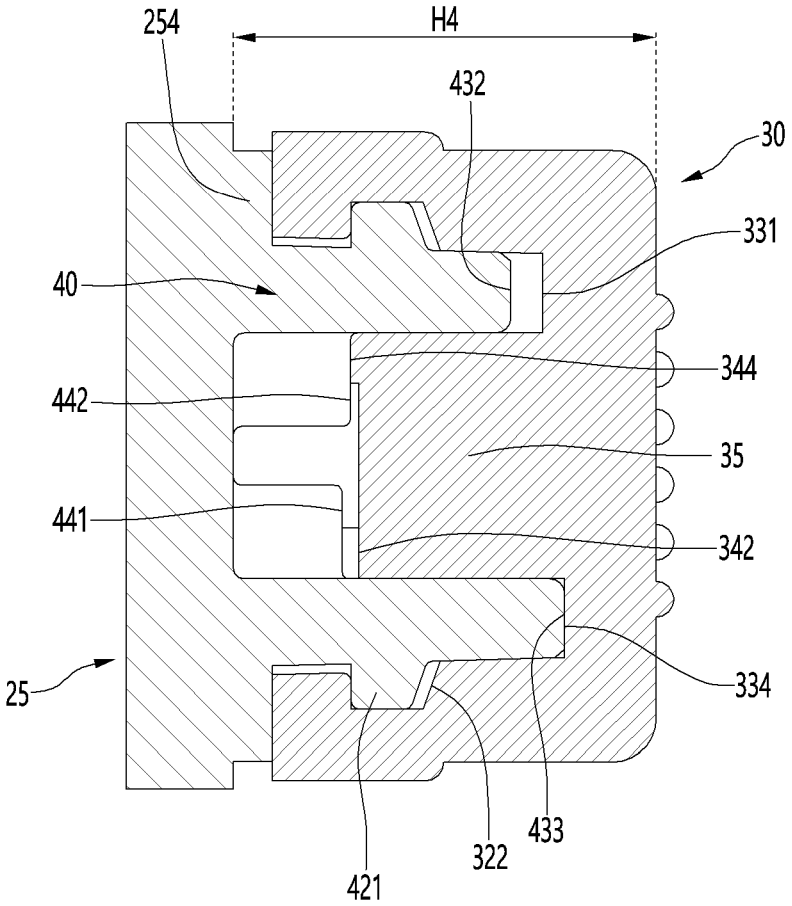
FIG. 25 is a cross-sectional view taken along line XXV-XXV' of FIG. 23.

FIG. 23 is a rear view illustrating a state when the gap adjusting device is adjusted to a fourth level height, FIG. 24 is a cross-sectional view taken along line XXIV-XXIV' of FIG. 23, and FIG. 25 is a cross-sectional view taken along line XXV-XXV' of FIG. 23.

As illustrated in the drawings, when the user rotates the adjusting member 30 by 270° counterclockwise with reference to FIG. 13 in a state the adjusting member 30 is separated and then mounts the adjusting member 30, as illustrated in FIGS. 23 to 25, the gap adjusting device 50 can be manipulated to have a fourth level height.

For example, in the third level height H4, a height of about 12 mm may be obtained from the rear surface of the door 20 to the rear end of the gap adjusting device 50. In other words, it can be seen that the height H4 of the gap adjusting device 50 increases by one level (0.5 mm) when compared to the third level height H3. Meanwhile, the gap adjusting device 50 may be located at the midpoint of the transverse length of the door 20, and thus, when the height of the gap adjusting device 50 increases by 0.5 mm, the gap G of the end portion of the door 20 can increase by 1 mm.

Looking in more detail at the state when the gap adjusting device 50 is adjusted to the fourth level height, the second main adjusting part 332 and the fourth main adjusting part 344 among the adjusting parts 36 by mounting after the rotation of the adjusting member 30 are positioned on the upper side. The second main adjusting part 332 may be spaced apart from the first main support part 431, and the fourth sub adjusting part 344 is in contact with the second sub support part 442, respectively and thus is in a supported state.

The fourth main adjusting part 334 and the second sub adjusting part 342 of the adjusting parts 36 are positioned at the lower side by mounting after rotation of the gap adjusting device 50. The fourth main adjusting part 334 is in contact with the third main support part 433, and the second sub-adjusting part 342 is in a state of being spaced apart from the first sub support part 441.

In this way, the adjusting part 36 and the support part 45 have a structure that supports each other at the upper and lower positions that are opposite to each other. Therefore, even if impact or load is applied to the contact part 31 at an eccentric position, the adjusting member 30 can be maintained without deviating from the mounting position.

The first main support part 431 and the second main support part 432 disposed on both left and right sides may be in a state of being spaced apart from the first main adjusting part 331 and the third main adjusting part 333. The first sub adjusting part 341 and the third sub adjusting part 343 may is in a state of not being in contact with the first sub support part 441 and the second sub support part 442.

When compared with the third level height H3 of FIGS. 20 to 22, the position of the adjusting part 36 supported by the seating part 40 by the mounting after the adjusting member 30 is rotated by 90° may be changed to the fourth main adjusting part 334 and the third sub adjusting part 343 which are one level higher. Accordingly, the distance G between the rear surface of the door 20 and the cabinet 10 increases, and the front surface of the door 20 can further protrude.

At this time, when the gap adjusting device 50 is mounted, the user can check the fourth level height H4 by placing the indicating part 311 consisting of four protrusions on the upper side, and the adjusting member 30 is accurately inserted and mounted in the seating part 40 by allowing the guide part 321 to be positioned upward, so that it is possible to adjust the desired correct height.

Meanwhile, in the present disclosure, various other embodiments may be possible in addition to the above-described embodiments. Another embodiment of the present disclosure is characterized in that the gap control device is provided on the cabinet side. Accordingly, there is only a difference only in the disposition position of the gap adjusting device, and all other configurations are the same, and the same configurations will be described using the same reference numerals, and detailed descriptions and illustrations thereof may be omitted.

Figure 26:
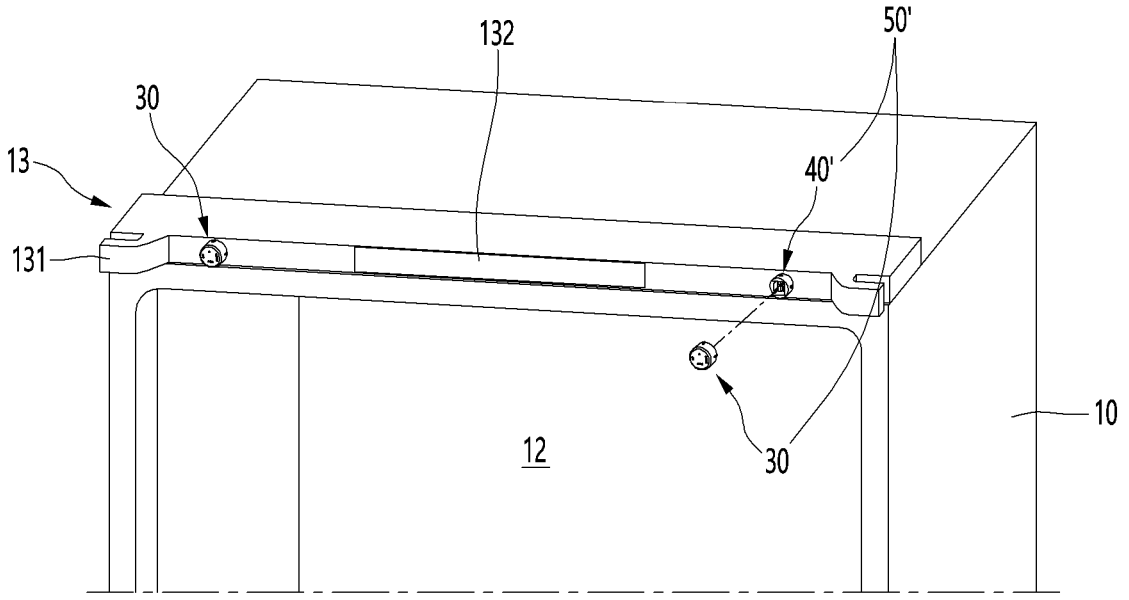
FIG. 26 is a partial perspective view illustrating a cabinet equipped with a gap adjusting device according to another embodiment of the present disclosure.

FIG. 26 is a partial perspective view illustrating a cabinet equipped with a gap adjusting device according to another embodiment of the present disclosure.

As illustrated in the drawings, a top cover 14 may be provided on the upper surface of the cabinet 10 of the refrigerator 1 according to another embodiment of the present disclosure. Hinge parts 141 may protrude from both ends of the top cover 14. A display 142 may be provided at a front central portion of the top cover 14. Although not illustrated, a pair of the doors 20 may be mounted on the hinge part 141 to open and close the storage space.

Meanwhile, a gap adjusting device 50' may be provided on the front surface of the top cover 14. The gap adjusting device 50' has the same structure as the above-described embodiment and may be mounted on the top cover 14.

In detail, the gap adjusting device 50' may be located between the hinge part 141 and the display 142, and when the door 20 is closed, the gap adjusting device 50' is in contact with the rear surface of the door 20 to support door 20. The gap adjusting device 50' may be formed to adjust a height protruding from the front surface of the top cover 14.

The gap adjusting device 50' may include a seating part 40' formed on the front surface of the top cover 14, and an adjusting member 30 detachably mounted to the seating part 40'. A position at which the seating part 40' is mounted is only the top cover 14, and a specific structure thereof may be the same as in the above-described embodiment. The adjusting member 30 may have the same structure as the above-described embodiment.

Accordingly, the adjusting member 30 may be mounted on the front surface of the top cover 14 on which the seating part 40' is formed, and when the adjusting member 30 is mounted, the contact surface between the support part 45 of the seating part 40' and the adjusting part 36 of the adjusting member 30 is determined, so that the protrusion height of the gap adjusting device 50' can be adjusted stepwise.

Meanwhile, when the top cover 14 is not formed on the upper surface of the cabinet 10, the gap adjusting device 50' may be directly mounted on the cabinet 10.

Meanwhile, in the present disclosure, various other embodiments may be possible in addition to the above-described embodiments. Another embodiment of the present disclosure is characterized in that the gap adjusting device is configured to adjust a step between a door and a wall surface or another refrigerator. Accordingly, there is only a difference in the shape of the refrigerator in which the gap adjusting device is disposed, but all other configurations are the same, and the same configurations will be described using the same reference numerals, and detailed descriptions and illustrations thereof may be omitted.

Figure 27:
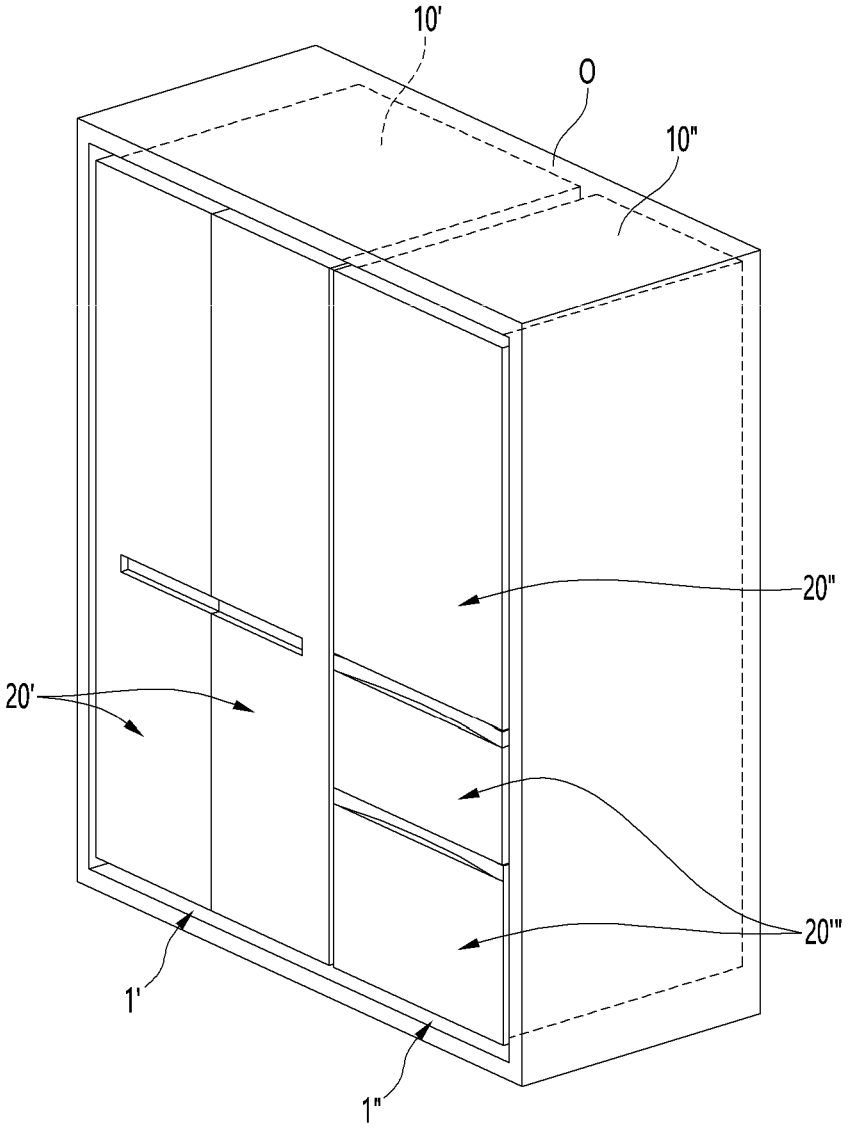
FIG. 27 is a perspective view illustrating a state where a refrigerator according to another embodiment of the present disclosure is installed.
Figure 28:
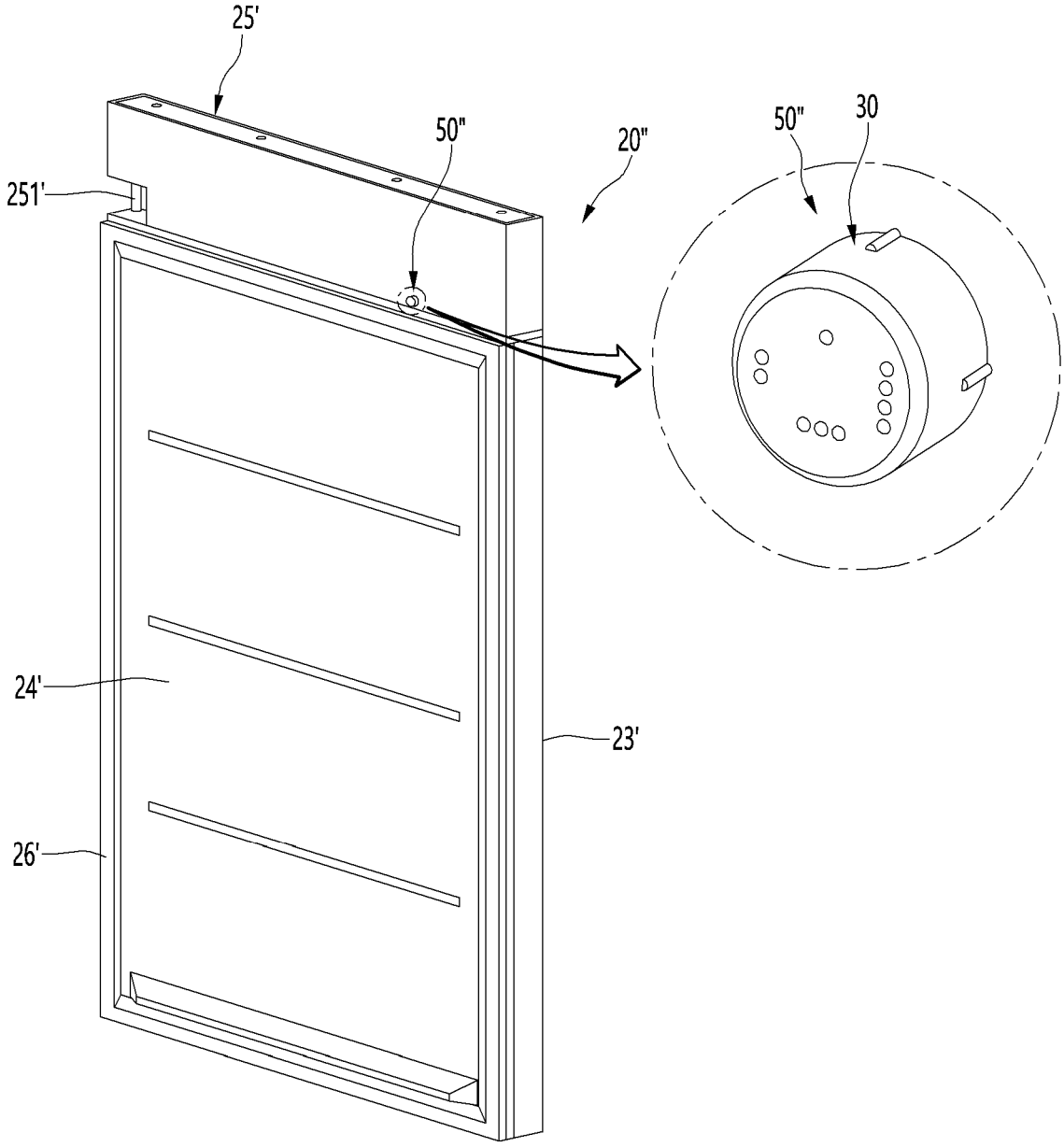
FIG. 28 is a perspective view illustrating the door of the refrigerator viewed from the rear.

FIG. 27 is a perspective view illustrating a state where a refrigerator according to another embodiment of the present disclosure is installed, and FIG. 28 is a perspective view illustrating the door of the refrigerator viewed from the rear.

As illustrated in the drawing, an overall outer appearance of a refrigerator 1' and 1" according to another embodiment of the present disclosure may be formed by cabinets 10' and 10" forming a storage space with an opened front surface, and doors 20', 20", and 20'" opening and closing the storage space.

The refrigerators 1' and 1" may be mounted so as to harmonize with the furniture or wall O of the indoor space. For example, as illustrated in FIG. 27, the refrigerators 1' and 1" may be installed in an indoor space such as a kitchen and may be disposed adjacent to furniture or a wall O to harmonize. In other words, a space corresponding to the size of the refrigerator 1' and 1" may be provided in the furniture or wall O, and the refrigerator 1 may be received or may be disposed in a built-in type.

The refrigerators 1' and 1" may be disposed in parallel in succession. In other words, a space in which a plurality of refrigerators 1' and 1" can be disposed may be provided by furniture or a wall O.

The plurality of refrigerators 1' and 1" may have the same structure, and refrigerators 1' and 1" having various structures may be disposed in combination as necessary. As an example, as illustrated in FIG. 27, a double-door refrigerator can be configured in which the refrigerator 1' on the left has storage spaces formed on both left and right sides, and which opens and closes the storage spaces on both sides by a pair of doors 20. The pair of doors 20' may be configured to open and close in a rotating manner, and these doors 20' may be referred to as French type doors.

Meanwhile, in the refrigerator 1" disposed on the right side of the refrigerator 1', the storage space may be divided up and down, and the doors 20" and 20'" to open and close the storage space divided up and down, respectively, can be placed up and down. In other words, the refrigerator 1" may be configured such that a door 20" that is opened and closed in a rotational manner is provided at the upper side, and a door 20'" that is opened and closed in a sliding manner is provided at the lower side.

The refrigerator 1' is disposed adjacent to the adjacent refrigerator 1", furniture, or wall O and may be disposed close so that the clearance between the adjacent refrigerator 1', 1", furniture, or wall O can be minimized in the range which does not interfere with each other when the doors 20', 20", or 20'" is opened and closed.

Meanwhile, when the doors 20', 20", 20'" of the refrigerator 1', 1" are closed, it is preferable that the front surfaces of the doors 20', 20", and 20'" are positioned on the same flat surface, but according to the load applied to the side of the door 20', 20', and 20'" during the use of the refrigerators 1' and 1" or the installation and use environment of the refrigerators 1' and 1", the closing amount of the door 20', 20", and 20'" may vary, and thus the protrusion degree of the door 20', 20", and 20'", that is, the height in the front and rear direction may vary.

In this case, the front surfaces of some of the doors 20', 20", and 20'" of the doors 20', 20", and 20'" may further protrude and be positioned in front of the front surface of the other door and thus have a step from each other. If the door 20', 20", and 20'" has a step, a sense of unity with other adjacent doors 20', 20", and 20'" or surrounding furniture or walls O cannot have. Therefore, it is possible to adjust the protrusion height of the door 20', 20', and 20" by using the gap adjusting device 50 provided in the door 20', 20", and 20'".

The gap adjusting device 50 can be applied to all of the doors 20', 20", and 20'" of the refrigerator 1' and 1", and hereinafter, in order to prevent duplication of description and for the convenience of understanding and explanation, we will look in more detail on the basis of the one provided in the door 20" provided in the upper portion of the refrigerator 1" on the right of the refrigerators 1' and 1" of FIG. 27.

The refrigerator 1" may include a door 20" for opening and closing an upper storage space. Hinges are coupled to the upper and lower ends of the door 20", respectively, so that the door 20" may be rotatably coupled to the cabinet 10".

The rear surface of the door 20" may be provided with the gap adjusting device 50 for adjusting to maintain the same front height while the doors 20" are closed.

In detail, the outer appearance of the door 20" may be formed by a front plate 23' forming a front surface, a door liner 24' forming a rear surface, and cap decos 25' forming an upper surface and a lower surface, like the door of the above-described embodiment.

The cap deco 25' may form an upper end of the rear surface of the door 20', and the rear surface of the cap deco 25' may be positioned above the gasket 26' mounted along the circumference of the door liner 24'.

The gap adjusting device 50 may be provided on the rear surface of the door 20", that is, the rear surface of the cab deco 25'. The gap adjusting device 50" may protrude from the rear surface of the door 20". The gap adjusting device 50" may be provided on one side of the left and right sides of the cab deco 25' far from the hinge mounting part 251'.

The gap adjusting device 50" may include a seating part and an adjusting member. The seating part may be formed on the rear surface of the cap deco 25', and the structure and shape of the seating part 40 may be the same as those of the above-described embodiment. The adjusting member 30 may be detachably mounted to the seating part 40, and the structure and shape of the adjusting member 30 may be the same as those of the above-described embodiment.

Although not illustrated, the support part 45 and the adjusting part 36 are formed in the seating part 40 and the adjusting member 30 to adjust the protrusion height of the gap adjusting device 50" according to the rotation angle when the adjusting member 30 is mounted.

As described above, the gap adjusting device 50" may have the same structure as the above-described embodiment and may be applied to various refrigerator types and doors. By adjusting the protrusion height of the front surface of the door 20" according to the mounting direction of the gap adjusting device 50", and thus it is possible to prevent the occurrence of a step with the door 20' of the neighboring refrigerator 1' or surrounding furniture or walls O.

In the refrigerator according to the proposed embodiment, the following effects can be expected.

The refrigerator according to the embodiment of the present disclosure includes a seating part in which a gap adjusting device is integrally formed with a cap deco, and an adjusting member mounted on the seating part, and thus there is an advantage that the configuration thereof is very simple and it is very easy to assemble. Therefore, it can be expected to reduce manufacturing costs thereof and improve productivity thereof.

The gap adjusting device can manipulate the protrusion height of the gap adjusting device by a simple operation of mounting the adjusting member after separation of the adjusting member, and thus, there is an advantage of improving the usability.

In particular, in order to adjust the protrusion height of the gap adjusting device, the adjusting part and the support part which are in contact with each other are continuously formed in multiple stages and may have a structure that is rotated about the center of the seating part. Accordingly, when the user rotates the adjusting member by a desired angle when mounting the adjusting member and then mounts the adjusting member on the seating part, the selected adjusting part and the support part are in contact with each other so that the adjusting member can protrude by a set height. In other words, there is an advantage that the protrusion height of the gap adjusting device can be adjusted by simply detaching and installing the adjusting member, and the gap between the cabinet and the door can be adjusted.

An indicating part is formed on the adjusting member to visualize the height adjusted by the operator, thereby enabling the user to more conveniently and accurately adjust the gap between the cabinet and the door.

A guide part is formed in the adjusting member so that the adjusting member can be assembled at an accurate position, and the assembly position is visualized to the user, thereby making the operation more convenient and easier.

The adjusting member and the seating part may be firmly coupled to each other by coupling of a fixing protrusion and a fixing groove when the adjusting member is mounted. Therefore, there is an advantage of preventing arbitrary separation or change of position of the adjusting member.

There are advantages that the fixing protrusion and the fixing groove are formed at positions corresponding to a plurality of adjusting parts and support parts for adjusting the height of the gap adjusting device, so that the adjusting member can be assembled at the correct position and the assembled state is maintained at the correct position.

Further, a structure in which the protrusion part of the adjusting member can be inserted into the space of the seating part is provided, and in this case, the cross section of the space of the seating part and the protrusion part may be formed in a corresponding polygonal shape. Accordingly, when the step adjusting device is inserted, accurate height adjustment is ensured and misassembly thereof is prevented, thereby ensuring reliability of manipulation.

There is an advantage that the outer surface of the seating part body is in contact with the inner surface of the adjusting member space, and the inner surface of the seating part body has a structure in contact with the outer surface of the protrusion part, so that the adjusting member cannot be easily separated or inclined in a state of being mounted and can maintain a sturdy mounting condition.

There are advantages that at least two of the plurality of adjusting parts and the support parts may be in contact with each other according to the mounting state of the adjusting member, respectively, and in particular, when the door is opened and closed by maintaining contact states at positions facing each other such as up and down or left and right, even if impact is applied to the adjusting member, the adjusting member is not inclined or separated, and a stable mounting state can be maintained.

By manipulating the gap adjusting device, the protrusion height of the gap adjusting device may be adjusted, and the protrusion height of the front surface of the door may be adjusted. Accordingly, there is an advantage that the front surface of the door has the same height as the neighboring door, thereby preventing a step between the doors and improving the outer appearance.

There is an advantage that, even when a plurality of refrigerators are disposed in parallel, the heights of the front surface thereof and other adjacent doors can be adjusted to be the same, and the heights of the front surface thereof and the other household appliances or furniture that are consecutively disposed can be the same. In addition, due to the built-in mounting, it is possible to adjust so that the heights of the front surface thereof and the neighboring furniture or walls can be same, thereby improving the installation outer appearance. In particular, when it is built-in with a plurality of home appliances or refrigerators, these advantages can be maximized.

What is claimed is:

1. A refrigerator comprising:

a cabinet that defines a storage space;

a door configured to open and close the storage space; and a gap adjusting device disposed between the cabinet and the door and configured to adjust a gap between the cabinet and the door to one of a plurality of predetermined level heights, the gap adjusting device comprising:

a seating part disposed at the door, and an adjusting member detachably disposed at the seating part and configured to contact the cabinet based on the door being closed, the adjusting member comprising one or more adjusting parts that have different heights from one another and that are configured to selectively contact the seating part, wherein the gap adjusting device is configured to adjust the gap between the cabinet and the door by bringing the seating part in contact with one of the one or more adjusting parts, wherein the seating part comprises a plurality of support parts configured to selectively contact the one or more adjusting parts, the plurality of support parts having different heights from one another, wherein the plurality of support parts define a plurality of supporting surfaces that face a front surface of the cabinet and are parallel to one another and wherein the adjusting member is configured to be rotated relative to the seating part to thereby bring one of the one or more adjusting parts in contact with one of the plurality of support parts such that the gap is adjusted to the one of the plurality of predetermined level heights.

2. The refrigerator of claim 1, wherein the seating part protrudes from a rear surface of the door and is configured to be inserted into the adjusting member, and wherein the one or more adjusting parts are disposed inside the adjusting member.

3. The refrigerator of claim 1, wherein the one or more adjusting parts comprise a plurality of adjusting parts that have different heights from one another and that are arranged stepwise along a rotational direction about a center of the adjusting member.

4. The refrigerator of claim 1, wherein the one or more adjusting parts comprise a plurality of adjusting parts that have different heights from one another, and wherein adjacent adjusting parts among the plurality of adjusting parts have ends that are connected to each other and define a step between the adjacent adjusting parts.

5. The refrigerator of claim 1, further comprising a gasket that is disposed at a rear circumference of the door and that is configured to contact a front surface of the cabinet, the gasket being configured to provide airtight sealing between the door and the cabinet, and wherein a height of the gap adjusting device is configured to be adjusted corresponding to a thickness of the gasket that is exposed to an outside of the door based on the door being closed.

6. The refrigerator of claim 1, wherein the adjusting member is configured to, based on being detached from the seating part, be rotated to one of a plurality of predetermined orientations relative to the seating part and then linearly moved to the seating part to thereby bring one of the one or more adjusting parts in contact with one of the plurality of support parts.

7. The refrigerator of claim 6, wherein the seating part comprises a seating part body that protrudes from a rear surface of the door and that defines a seating part space inside the seating part body, the seating part space being recessed toward the rear surface of the door and configured to receive a part of the adjusting member.

8. The refrigerator of claim 7, wherein the plurality of support parts comprise:

one or more main support parts disposed at the seating part body; and one or more sub support parts disposed in the seating part space.

9. The refrigerator of claim 8, wherein the one or more main support parts define multiple stages along a circumference defined by a protruding end portion of the seating part body.

10. The refrigerator of claim 9, wherein the one or more sub support parts comprise a plurality of sub support parts that protrude from a rear surface of the seating part body, the plurality of sub support parts facing one another and having different heights from one another.

11. The refrigerator of claim 8, wherein the adjusting member comprises:

a contact part configured to contact the cabinet based on the door being closed;

a circumferential part that extends from a circumference of the contact part toward the rear surface of the door and is in contact with an outer surface of the seating part body, the circumferential part defining an adjusting member space therein; and a protrusion part that protrudes from an inside of the adjusting member space toward the rear surface of the door and is inserted into the seating part space.

12. The refrigerator of claim 11, wherein a cross-section of the protrusion part and a cross-section of the seating part space have a polygonal shape and correspond to each other.

13. The refrigerator of claim 11, wherein the one or more adjusting parts comprise:

a plurality of main adjusting parts that are disposed inside the adjusting member space and that protrude to different heights from one another, the plurality of main adjusting parts being arranged along a space between the circumferential part and the protrusion part; and a plurality of sub adjusting parts arranged along a circumference of an end portion of the protrusion part, the plurality of sub adjusting parts having different heights from one another, wherein at least one of the plurality of main adjusting parts is configured to, based on the adjusting member being coupled to the seating part, contact one of the one or more main support parts, and wherein at least one of the plurality of sub adjusting parts is configured to, based on the adjusting member being coupled to the seating part, contact one of the one or more sub support parts.

14. The refrigerator of claim 13, wherein at least two of the plurality of main adjusting parts are configured to face and contact the one or more main support parts, and wherein at least two of the plurality of sub adjusting parts are configured to face and contact the one or more sub support parts.

15. The refrigerator of claim 1, wherein the seating part comprises a fixing protrusion that protrudes outward from a circumferential surface of the seating part, wherein the adjusting member defines a fixing groove at an inner surface therefore, the fixing groove being configured to receive the fixing protrusion to thereby restrict movement of the adjusting member, and wherein the seating part is configured to be in contact with the adjusting member based on the fixing protrusion being inserted into the fixing groove.

16. The refrigerator of claim 1, wherein the adjusting member comprises one or more indicating parts disposed at a rear surface of the adjusting member that is in contact with the cabinet, and wherein each of the one or more indicating parts is located at a position corresponding to one of the one or more adjusting parts to thereby indicate one of the heights of the one or more adjusting parts.

17. The refrigerator of claim 1, wherein the adjusting member comprises a guide part that is disposed at a circumferential surface of the adjusting member, the guide part protruding outward from a position corresponding to each of the one or more adjusting parts to thereby visualize a correct mounting direction of the adjusting member.

18. The refrigerator of claim 1, further comprising an upper cap deco that is disposed at an upper end of the door and defines an upper surface of the door, and wherein the seating part is an integral part of the upper cap deco and disposed on a rear surface of the upper cap deco.

19. The refrigerator of claim 18, further comprising:

a hinge that rotatably couples to the door to the cabinet; and a top cover that protrudes upward from an upper surface of the cabinet and receives the hinge, wherein the adjusting member is configured to, based on the door being closed, contact a front surface of the top cover.

20. The refrigerator of claim 1, wherein at least a portion of the adjusting member is made of an elastic material.

* * * * *